US009834361B2

(12) United States Patent
Baker

(10) Patent No.: US 9,834,361 B2
(45) Date of Patent: Dec. 5, 2017

(54) ENCASEMENT PROTECTIVE APPARATUS

(71) Applicant: Roger James Baker, Aurora, CO (US)

(72) Inventor: Roger James Baker, Aurora, CO (US)

( * ) Notice: Subject to any disclaimer, the term of this patent is extended or adjusted under 35 U.S.C. 154(b) by 27 days.

(21) Appl. No.: 14/990,640

(22) Filed: Jan. 7, 2016

(65) Prior Publication Data

US 2016/0194135 A1 Jul. 7, 2016

Related U.S. Application Data

(60) Provisional application No. 62/100,483, filed on Jan. 7, 2015.

(51) Int. Cl.

| | |
|---|---|
| ***B65D 85/00*** | (2006.01) |
| ***B65D 81/20*** | (2006.01) |
| ***B65D 81/03*** | (2006.01) |
| ***A45F 5/00*** | (2006.01) |
| ***A45C 3/00*** | (2006.01) |
| ***A45C 7/00*** | (2006.01) |

(52) U.S. Cl.

CPC ..... *B65D 81/2038* (2013.01); *A45C 3/001* (2013.01); *A45C 7/0081* (2013.01); *A45F 5/00* (2013.01); *B65D 81/03* (2013.01); *A45F 2200/0591* (2013.01)

(58) Field of Classification Search

CPC ..... B65D 81/00; B65D 81/18; B65D 81/20; B65D 81/2023; B65D 81/2038; B65D 81/03; A45C 3/00; A45C 3/001; A45C 7/00; A45C 7/0036; A45C 7/004; A45F 5/00

USPC ..... 206/317, 315.1, 521, 524.8, 591, 592, 206/594, 584; 5/911; 602/6; 150/154

See application file for complete search history.

(56) References Cited

U.S. PATENT DOCUMENTS

| | | | | |
|---|---|---|---|---|
| 7,063,737 | B2 * | 6/2006 | Tilby | F41C 33/06 190/125 |
| D677,049 | S * | 3/2013 | Pennington | D3/262 |
| 8,387,789 | B2 * | 3/2013 | Baker | B63B 35/7946 206/315.1 |
| 2010/0006469 | A1 * | 1/2010 | Allouche | B63B 35/7946 206/523 |

* cited by examiner

*Primary Examiner* — Steven A. Reynolds
*Assistant Examiner* — Javier A Pagan
(74) *Attorney, Agent, or Firm* — Roger A. Jackson

(57) ABSTRACT

A protective apparatus for an article, the apparatus including a surrounding sidewall having a first end portion and an opposing second end portion, the sidewall also having a perpendicularly oriented first margin portion and an opposing second margin portion, also with a primary interior. The interior includes a plurality of flexible longwise channels that are attached in a juxtapose position to one another. In addition, included is a plurality of particulate items loosely disposed within each of the flexible longwise channels and a structure for removable engagement positioned adjacent to the first and second margins. The removable engagement structure facilitates the first and second margins to be removably engaged allowing the surrounding sidewall to envelope the article. The primary interior can be evacuated, thus removing the air spaces between the particulate items and in the interior resulting in rigidifying the surrounding sidewall partially encompassing the article to protect the article.

9 Claims, 14 Drawing Sheets

ENCASEMENT PROTECTIVE APPARATUS

RELATED PATENT APPLICATION

This application claims the benefit of U.S. provisional patent application Ser. No. 62/100,483 filed on Jan. 7, 2015 by Roger James Baker of Aurora, Colo., U.S.

FIELD OF THE INVENTION

The present invention generally relates to protective covers and cases for articles. More particularly, the present invention discloses protective covers for smaller hand held articles, namely guns, collector's items, and the like that are planar in nature.

DESCRIPTION OF THE RELATED ART

Up until now there have been relatively moderate efforts in designing and manufacturing a fully engineered protective cover for handheld planar type articles, a number of the current protective covers available for hand held articles to the consumer appear to be design afterthoughts in that they are nothing any more special than a foam padded pocket being similar to a laptop bag in basic construction. The typical protective cover has a zippered enclosure with a soft foam padded lining with a nylon type fabric cover, wherein the protective cover very loosely fits around the article. The current other protective cover materials available are typically various forms of corrugated cardboard, bubble wrap, or sheet foam padding that at the very best only moderately protect the article, this being primarily due to the packaging and protective cover materials being inherently soft and flexible and also fitting around the outer surface of the article in a very loose manner, due to the protective cover attempting to fit a wide variety of article sizes.

What this results in that if another piece of cargo or transport vehicle wall becomes adjacent to the article during shipping or transport and comes in contact with the currently available protective cover, the cover firstly will not have any structural rigidity to resist any sort of point impact to protect the article, and secondly with the relative movement being allowed to the article within the cover during the normal shipping inertia loads, the article will tend to bang around especially on its outer periphery against the inside of the protective cover allowing further damage to the outer periphery of the article and again causing potential damage to the surface finish of the article, this is especially critical in that this shifting of the article within the protective cover during transit is highly cyclical, (due to vehicle motion) i.e. occurring numerous times (in the thousands), thus the aforementioned damage can become highly cumulative in nature.

Therefore, two very basic desirable things come to light to maximize the shipping and transport protection given to the article. The first desirable thing is "structural rigidity", in other words the protective cover should be able to handle a point load impact and be able to handle a bending load imposed upon the article along its longest axis from end to end. Wherein the aforementioned point load impact and bending load are placed upon the exterior of the protective cover, the protective cover would have the rigidity to absorb the brunt of this external loading by being its own rigid structure, thus not transmitting these external protective cover loads to the article itself. The second desirable thing for the protective cover is to have a very snug and close-fitting fit to the exterior surface of the article, that absolutely minimizes the relative movement of the article within the protective cover during transport or shipment. As this snug fitting concept will go a long way toward preventing the previously described high-frequency occurrence and cumulative damage to either the exterior surface finish of the article or damage to the exterior surfaces being principally upon the outer periphery of the article.

The well-known problem to accomplishing the above two mentioned things for a protective cover typically requires a totally custom made hard shell enclosure that has an interior that is also custom fit and cut to the external surface of the article, as is typically used in specialized cases made for high value electronic equipment that is frequently shipped or transported frequently. To address one of these two things, the prior art in differing art areas has used air pressure to create temporary rigidity in structures, wherein as long as the air negative or positive pressure remains in place the normally flexible structure is rigid, with the structure becoming flexible once again when the air negative or positive pressure returns to atmospheric pressure. To address the close fitting requirement, the prior art has had solutions that are permanent, such as expandable polyurethane foam, that can certainly precisely encase an article's unique external shape for shipping without any relative movement of the article in the foam casing, however, the foam casing being permanent in shape and not reusable or very durable, thus being acceptable for one time shipping from factory to user, however, not being acceptable for multiple transport scenarios, where the article is transported multiple times to its site of usage or where a different article is used that is a slightly different size.

Starting in the prior art for an air rigid type apparatus with United States Patent Application Number 20080289640 to Kline, disclosed is a vacuum activated device for holding a human immobile. The device in Kline includes a rigid frame of a three dimensional shape large enough to surround a human torso and a bag comprised of a flexible, air impermeable material enclosing the frame with a closure on the bag being necessary to allow an occupant to enter or be placed within it. In Kline, when air is evacuated through a hole in the bag its surface will collapse around the frame and the occupant's body with the rigidity of the frame in combination with the pressure applied to the occupant by the surface of the bag will impede further movement by the occupant wherein a means to allow the occupant access to breathable air will is provided.

Continuing in the prior art for an air rigid apparatus in U.S. Pat. No. 7,273,462 (2007) to Rugfelt, et al. disclosed is an apparatus for supporting and stabilizing an injured person or an injured limb, with a flexible film element enclosing an airtight inner region that can be evacuated. The film element in Rugfelt is provided with two insertion bodies which respectively are formed with two air-permeable, flexible material strips and each insertion body is divided into chambers containing loose particles, by way of intersecting seams formed between the material strips. The seams in Rugfelt on both insertion bodies are staggered in relation to each other in both directions in such a way that the particles combine to form a substantially homogenously thick particle layer. Further, Rugfelt teaches a device for stabilizing an injured body part with a flexible film element enclosing an airtight region that can be evacuated, wherein the film element has two air permeable flexible material strips forming an insertion body that is divided into chambers containing loose particles, with the seams of the material strips are staggered to one another in both directions, such that the particles form a homogeneously thick particle layer, see FIGS. 1 through 4.

As Rugfelt's goal is to support and stabilize an injured body part, see column 2, lines 5 to 19, the point of the evacuated chamber to solely "stiffen" the film element, i.e. to stabilize the injured body part, wherein constant stiffness in all directions is important, which in having cross pieces or long thin chambers within the film element causes buckling zones as between chambers is taught as being undesirable, further the long thin chambers require manual redistribution of the particle for evening-out the particle distribution within each chamber. Another issue import to Rugfelt's application is the elimination of shrinkage of the film element during evacuation, see column 2, lines 20 to 31, as shrinkage in the film element of any form while evacuating the film element as against an injured body part is very undesirable as having potential for causing added injury due to compression movement in any direction of the film element as against the injured body part.

Ideally, Rugfelt's goals during film element evacuation, are to have the film element simply becoming rigid evenly in all directions with minimal or no shrinkage, thus simply holding the injured body part in place for transport without applying any added loading to the injured body part either through uneven (longitudinal versus lateral) stiffness or loading of the film element from evacuation or having any shrinkage, i.e. film element movement as against the injured body part during evacuation, see column 2, lines 35 to 42. Rugfelt teaches the structure to accomplish the above mentioned goals is somewhat similar to Korfmacher in the formation of a mat type structure, however, Rugfelt adding a matrix grid type structure for the interior chambering seaming resulting in small volume wise chambers thus absolutely avoiding a continuous chamber in any direction from the seams intersecting at right angles, see column 2, lines 43 to column 3, line 34.

Looking in particular at FIGS. 1 and 2, and column 4, line 23 to column 5, line 41, in Rugfelt, there is an outer film 2, and four sheets of air permeable material 4, divided by seams 9 with right angle seams 10 that divide the sheets 4 into small square chambers 5, the two insert bodies 3, in looking at FIGS. 1 and 3, in relation to the right angle intersecting seams 9 and 10 intersections are offset to one another by one half the distance in both the longitudinal and transverse directions, as indicated by the lower insert body 3 having seams 9 and 10 indicated by dashed lines, see column 4, lines 49 to 63, this results in a completely symmetric chamber configuration (similar to a quilted blanket) thus resulting in the plurality of chambers 5 resembling a matrix of two layers of small pillows that are positioned such that their outer edge seams are offset from one another, thus if one were to take a cross section of the matrix grid structure at two right angles to one another, the cross section would be the same, in going with Rugfelt's goals of minimizing shrinkage during evacuation in any direction and to provide symmetric rigidity of the matrix grid structure as the most desirable goals for supporting the injured body part.

Further in the prior art in this same area of air pressure rigid structures in U.S. Pat. No. 3,745,998 (1973) to Rose, disclosed is an emergency immobilization and extrication device similar to Rugfelt except that the longitudinal chambers are used for the particulate filler to enhance lengthwise rigidity for the limb, further a system of foraminous distribution between chambers for vacuuming is disclosed along with soft and irregular particulate matter being claimed as forming a more rigid structure when subjected to a vacuum pressure. Next in the prior art again for solidifying flexible structures via air is in U.S. Pat. No. 5,154,185 (1992) to Latimer that discloses an emergency immobilization device that allows the particulate materials to be manually shifted to provided additional stiffening in selected areas of the support. Further, in the prior art for air rigidity structures in U.S. Pat. No. 4,657,003 (1987) to Wirtz disclosed is an emergency immobilization device similar to Latimer in function, wherein the particulate materials are to be manually shifted to provide additional stiffening in selected areas of the support, with a different interior chamber system.

Also in the prior art for air rigid based structures, in U.S. Pat. No. 5,826,583 (1998) to Wood disclosed is an emergency immobilization and extrication device that permits a victim of spinal column trauma to be firmly supported and immobilized for transportation. The device in Wood comprises a container filled with a multiplicity of small, resilient particles resting in a light-weight rigid base-board, and having a sliding rigid cover. The container in Wood comprises means for inflating with gas and deflating, see abstract. Wood claims "flexible sub-containers in the shape of a human body" within the device, where each sub-container is filled with a plurality of deformable and resilient particles, having container perforations sufficiently small so that the gas but not the particles may travel freely from one sub-container to another, see column 6, lines 2-7.

Next, in the prior art for air rigid devices, in United States Patent Application Publication Number 20040082891 to Daugherty, et al. disclosed a vacuum splint device for securely immobilizing an injured limb or other body part. The device in Daugherty et al., includes a plurality of T-shaped straps for insertion through slots on the sleeve of the device. Each strap in Daugherty et al., may be folded over the slots and back upon itself to fasten the end of the strap to the device. The sleeve of the Daugherty et al., device includes a plurality of particles that are initially separated by air to allow for the device to be flexible. Once placed on the injured body part, the air may be removed from the Daugherty et al., device using an intake/exhaust valve tube assembly to compress the particles together to form a substantially rigid sleeve. A filter in Daugherty et al., is on the valve tube assembly to ensure that the particles remain within the sleeve.

Once the air is removed from the Daugherty et al., device, a clamp may be used on the tube of the valve tube assembly to prevent any air from flowing into the tube. Upon removal of the Daugherty et al., device from the injured limb, the straps may be removed from the device for replacement or washing. Air may be introduced into the sleeve by undoing the clamp so as to allow air to reenter the interior in the Daugherty et al., device and separate the particles and allow the device to be folded.

Also in the prior art area for what is termed "vacuum splints" in U.S. Design Pat. No. D261,430 (1981) to Baturin disclosed is the ornamental design for a vacuum splint having a mattress shape where the particles inside the split are divided into circumferential chambers, and two primary chambers exist along the length of the mattress, and several additional chambers exist along the width of the mattress, see FIGS. 1, 4, and 6, note that this is a design patent, and thus cannot really teach the function of how the invention works.

Next looking in the prior art at sportboard specific protective covers in United States Patent Application Publication Number 20070125671 to Stephens, disclosed is an industry standard packaging design to ship and protect surfboards, wakeboards, snowboards, kiteboards, etc. in various sizes. Stephens uses corrugated die-cut end caps, flexible straps, and foam and corrugated pads to provide enhanced fragility protection in an easy to assemble/disassemble and reusable package. This package in Stephens makes it possible to ship expensive board products around the world safely and cost effectively for OEM Bulk and retail single/bulk deliveries, see abstract, however, not really being designed to be reusable for multiple transportation use scenarios.

Continuing in this prior art area for sportboard specific protective covers in United States Patent Application Publication Number 20100006469 to Allouche disclosed is a surfboard case that includes a body which has an interior that is structured to stretchably adapt to a surfboard having a predetermined shape and size. The body in Allouche is further structured to substantially cushion an impact to the surfboard contained within the surfboard case. In at least one instance in Allouche, a substantial portion of the surfboard case comprises a neoprene material of construction. The surfboard case in Allouche also includes at least one reinforcement section disposed in protective relation to a predetermined portion of the surfboard, see abstract.

Further, in this prior art area for sportboard specific protective covers in U.S. Pat. No. 4,483,380 (1984) to Beran disclosed is a foldable protective cover and carrier for sports equipment. The cover in Beran includes an outer layer of protective material such as nylon and an inner layer of cushioning material such as foam plastic. A pocket in Beran is provided at each longitudinal end of the cover at the inner side, and four laterally extending straps are spaced along the outer layer of material with two straps being at the longitudinal ends and the other two inwardly thereof. Reinforcing strips in Beran extend laterally across the longitudinal ends of the cover and a third reinforcing strip having a fifth strap connected therewith extends between the inwardly positioned straps to form a handle at one side edge when the cover is fully assembled. Sports equipment, such as a surfboard, is placed on the inner side of the unfolded cover in Beran, preferably with the bottom facing upwardly, and the cover is folded over a surfboard in an overlapping fashion to provide a dual layer of protection for the bottom of the board The pair of inwardly positioned straps in Beran are the fastened about the board, after which the ends of the cover are folded around the board ends in such a manner that the dual layer of protection wraps continuously around the nose and tail of the board, after which the end straps are fastened.

Continuing in this prior art area of sportboard protective covers in U.S. Pat. No. 5,147,235 (1992) to Bamburak, et al., disclosed a protective cover for a surfboard or the like that has a cushioned end with protective pockets to enclose the fin(s), and also can cover an end of the surfboard. The fin-receiving pockets in Bamburak, et al., are formed between air-filled plenums or bodies of shock-absorbing material such as foam. A closure strap in Bamburak, et al., can encircle the surfboard for holding the protective cover in place, or a zipper closure can be provided, see abstract. Next, in the sportboard cover protective arts in U.S. Pat. No. 7,017,747 (2006) B2 to Kiger, et al. disclosed is a protective surfboard covering device including a cover that defines a plurality of inflatable cushions that may include a top surface cushion, a bottom surface cushion, and a pair of laterally spaced apart sidewall cushions, the cushions defining therebetween a surfboard compartment and cooperating to form a mouth through which the surfboard is inserted into the surfboard compartment, see abstract. Note, that in Kiger et al., using positive air pressure for rigidity is generally not as preferable as using negative air pressure with particulate matter, due to the situation when the air pressure is lost then for the positive pressure device as in Kiger et al., all cushioning and rigidity is lost, wherein with the negative pressure device such as a vacuum splint in Rose, wherein loss of air pressure will still result in some cushioning and rigidity of the device remaining.

Moving ahead in the sportboard protective cover arts, in U.S. Pat. No. 5,193,677 (1993) to Moreno disclosed a surfboard storage and carrying bag with a pneumatically inflated guard rail comprising of three circumferential tubes with each pneumatically inflated and attached inside a surfboard storage or carrying bag that when inflated provides a guard rail or bumper to protect the surfboard. Moreno also describes an inflatable pillow that protects fin protrusions, see abstract. Moreno would have the same problems as Kiger et al., is using a positive air pressure to add rigidity and cushioning to the protective cover. Next, in the sportboard protective cover arts, U.S. Pat. No. 5,094,344 (1992) to Savage disclosed is a surfboard carry case that includes a soft portion and a rigid hard portion, structured such that at least one surfboard can be carried therein, with a tail portion of the surfboard, including the fins, protectively encapsulated within the hard case portion.

Continuing, in the sportboard protective cover arts in U.S. Pat. No. 5,163,550 (1992) to Hawk disclosed is a protective cover for snowboards comprising an elastic elongated panel having an elastic cord around its outer peripheral edge which must be stretched in order to permit insertion of the snowboard such that the bottom of the snowboard is covered by the panel and the elastic cord snugly engages the top surface of the panel; and reinforcing layers are provided along the surrounding edge of the panel to overlap the edges of the snowboard. Noting, that Hawk recognizes the importance of protecting the outer periphery of the sportboard from damage.

Continuing, in the sportboard protective cover arts in U.S. Pat. No. 8,387,789 (2013) to Baker, disclosed is an encasement protective apparatus for an article preferably in the form of a surfboard, the protective apparatus is evacuated thus compressing soft particles together to stiffen the apparatus for protecting the article during shipment. The protective apparatus in Baker is constructed of a fluid tight sealed cover that has disposed within intersticed first and second chambers that each have the soft particles disposed within, wherein the cover is wrapped about the article and the first and second chambers are evacuated to cause the cover to stiffen about the article for protecting the article.

Next, in the vacuum actuated packing nest arts in U.S. Pat. No. 5,351,830 to Bender et el., disclosed in a sealed bag that is air tight that is partially filled with a plurality of spherical foam pieces that are about 1/16 to 1/8 inch in diameter, wherein an article such as a camera is inserted into the bag, wherein the loose non evacuated bag forms about the article, with a manual vacuum pump evacuates the bag, thus causing the foam pieces to become tightly packed into one another forming a rigid enclosure about the article. However, in Bender, the article is directly exposed to the foam pieces which could result in foam pieces becoming trapped within cracks and crevices in the article being generally undesirable.

Moving onward, also in the vacuum actuated packing nest arts in U.S. Pat. No. 5,595,806 to Korfmacher disclosed is a mat for bearing and supporting an article for packaging, wherein the mat is airtight envelope having a valve and a partial fill of granular material that is lodged within an air permeable fabric sack with spacing controlled by spacer threads causing the fabric to have parallel panels. However, in Korfmacher the granular material is free to move within the entire parallel gap formed by the spacer threads and the fabric, which can have the undesirable effect of allowing the granular material to bunch up in a particular corner on the airtight envelope, thus causing an uneven padding effect from the granular material, especially when the granular material is vacuumed out and becomes rigid.

Continuing now in the medical table arts, in U.S. Pat. No. 5,855,207 to Moenning et al., disclosed is a medical table assembly having a plurality of parallel tubes that are adjacent to one another running lengthwise within the table, each tube is a separate air tight assembly with an inner tube that runs parallel with the granular material in-between the tubes, wherein the air is evacuated out through the inner tube. In Moenning, the purpose of the evacuation of the bed portion of the medical table is to rigidify the bed and tighten the patient restraints, obviously not encasing the patient.

Further, in the prior art wherein the article is in the form of a firearm in U.S. Pat. No. 6,253,915 to Mesica, et al. disclosed a protective pouch for firearms that includes a compartment defined by front and rear faces and a peripheral face between the front and rear faces. A zipper opening mechanism in Mesica provides access to the inside of the pouch and the pouch is constructed of a fabric-like material having bulletproof characteristics. The pouch in Mesica includes a mechanism for securing a firearm within the pouch, plus a lock may also be included to restrict access to the contents of the pouch.

Continuing, in the prior art wherein the article is in the form of a firearm in U.S. Pat. No. 4,463,847 to Gordon disclosed is a rust-preventive firearm receptacle comprising a water-vapor-impervious material cover defining a cavity, a vapor-phase anti-rust inhibitor insert with active vapor-phase anti-rust inhibitor, a soft interior, including a pocket attached to the interior for replaceably receiving the insert, and a tape device mounted about the perimeter of the receptacle to seal the interior cavity thereof from outside air. The invention in Gordon is generally used by placing a chemical carrier insert into the cavity pocket such that when the firearm is carried within the sealed cavity of the receptacle, it is surrounded by the vapor-phase inhibitor emanating out of the insert and when inactive, the insert can be replaced.

Next, in the prior art also wherein the article is in the form of a firearm in U.S. Pat. No. 7,451,872 to Allen, disclosed is a weaponry container comprising: a plurality of elongated walls movably coupled to one another, each one of the walls having: (a) a length extending along a longitudinal axis, (b) a width extending along a lateral axis, the lateral axis intersecting with the longitudinal axis, (c) a perimeter, (d) an outer surface, at least part of the outer surface having a rigid characteristic, and (e) an inner surface, the elongated walls defining an inner space when the weaponry container is closed. Wherein in Allen, the inner space being configured to receive a first elongated weapon and a second elongated weapon; at least one fastener coupled to at least one of the elongated walls; a first weaponry holder coupled to the inner surface of a first one of the elongated walls, the first weaponry holder being flexible, the first weaponry holder having a plurality of sections, the sections being spaced apart from each other along an axis parallel to the lateral axis, each one of the sections extending from the inner surface, each one of the sections having a section end.

Further, in Allen at least one of the section ends having a first fastener configured to removably attach the section ends to each other, the sections defining a first holding space when the section ends are attached to each other, the first holding space having a size, the first fastener enabling adjustment of the size so that, when an end of the first elongated weapon is inserted into the first holding space: (a) said sections restrain a lateral movement of said end along the first axis; and (b) the first weaponry holder secures said end to the first elongated wall; a second weaponry holder coupled to the inner surface of the first elongated wall, the second weaponry holder being flexible, the second weaponry holder having a plurality of sections, the sections being spaced apart from each other along the axis parallel to the lateral axis.

Also in Allen, each one of the sections extending from the inner surface, each one of the sections having a section end, at least one of the section ends having a second fastener configured to removably attach the section ends to each other, the sections defining a second holding space when the section ends are attached to each other, the second holding space having a size, the second fastener enabling adjustment of the size so that, when an end of the second elongated weapon end is inserted into the second holding space: (a) said sections restrain a lateral movement of said end along a second axis; and (b) the second weaponry holder secures said end to the first elongated wall; and a flexible extension coupled to at least one of the walls, part of the flexible extension extending adjacent to at least a portion of the perimeters of the walls when the weaponry container is closed.

Moving onward, in the prior art again wherein the article is in the form of a firearm in U.S. Pat. No. 7,063,737 to Tilby, et al., disclosed a soft case for holding weapons as they are transported or stored that has a clam-shell type body with an upper half body and a lower half body interconnected by a hinge. In Tilby, the upper and lower half bodies and hinge are made from a foam plastic that is soft enough to protect a weapon surrounded by the upper and lower half bodies and capable of being permanently shaped under heat and pressure to have one-half of a weapon molded as a recess in the upper half body and an opposite side one-half of the weapon molded as a recess in the lower half body. Whereby in Tilby when the upper and lower body halves are pivoted about the hinge and into a face to face relationship, with a weapon positioned in the recesses formed in the half bodies and including a zipper for securing the body halves together and a handle for carrying the gun case. Wherein the problem in Tilby is the permanent shaped that the upper and lower bodies take for a particular firearm, wherein there are numerous firearm shapes that need to be accommodated which makes the Tilby case inflexible in this respect for securely holding the firearm without relative movement during shipment.

Yet further, in the prior art further wherein the article is in the form of a firearm in U.S. Pat. No. 5,924,565 to Colee, disclosed is a gun case having a waterproof outer shell and an oil impregnated inside fabric liner, and conjoined side-long and end access openings that allow the gun case to be quickly turned inside out and hung for cleaning and/or drying. Further in Colee secure fold-over hook and loop fastener closure flaps are provided for both openings to solidly retain the gun within the gun case and to prevent accidental opening and release of the gun. Padding is disposed between the patterned outer shell fabric and inner liner to cushion the gun as it is transported, and to maintain the buoyancy of the gun case so that it floats even with a gun contained therein. Thus in Colee, with just generic type padding the firearm only receives moderate protection, as the firearm by necessity has a loose cavity with which to move within the case that can result in damage to the firearm through movement within the case from handling.

What is needed is a protective cover that accomplishes is two very basic desirable things to maximize the shipping and transport protection given to the article. The first desirable thing is "structural rigidity", in other words the protective cover must be able to handle an external point load impact and be able to handle an external bending load imposed upon the article along its longest axis from end to end. Wherein, the aforementioned point load impact and bending loads are placed upon the exterior of the protective cover, wherein the protective cover will absorb and stand up to the brunt of this external loading by being its own rigid structure, thus not transmitting these external protective cover loads directly to the article itself or at least shielding the majority of the external loading from the article. The second desirable thing for the protective cover is to have a very snug and close-fitting fit to the exterior surface of the article, even with varying outer shapes of the article, that minimizes the relative movement of the article in the protective cover during transport or shipment being due to a molded around the article type rigid encasement of the protective apparatus. As this snug fitting concept will go a long way toward preventing the previously described high-frequency occurrence and cumulative damage to either the exterior surface finish of the article or damage to the exterior surfaces being principally upon the outer periphery of the article emanating from the undesirable relative movement as between article outer surface and the cover interior lining.

Therefore the challenge of the present invention is to have a protective cover apparatus that can custom fit itself to a multitude of different size articles and to have the structural rigidity necessary to adequately protect the article, while at the same time having the ability to be used with a number of different sizes of articles and being desirably flexible for storage and handling when the protective cover apparatus of the present invention does not have an article disposed within it.

SUMMARY OF INVENTION

Broadly, the present invention is of an encasement protective apparatus for enveloping an article includes a flexible surrounding sidewall that is substantially fluid tight about a longitudinal axis, wherein the surrounding sidewall has a substantially fluid tight first end portion and an opposing substantially fluid tight second end portion, with the longitudinal axis spanning therebetween. The surrounding sidewall also having a substantially fluid tight first margin portion and an opposing substantially fluid tight second margin portion, wherein the first and second margin portions are substantially parallel to the longitudinal axis, the surrounding sidewall also having an outer surface portion that is adjacent to an external environment and an inner surface portion that defines a primary interior formed by the sidewall. Wherein, the first and second end portions, the first and second margins, and where the outer surface portion is attached at the first and second end portions thus, forms a pocket that the article is disposed within. With the first and second margin portions at the outer surface being removably engagable to one another and that define a first aperture opening, thereby the pocket defining a secondary interior, further a second aperture is disposed therethrough the sidewall allowing fluid communication from the primary interior into the external environment.

Further included in the encasement protective apparatus are a plurality of flexible longwise channels disposed within the primary interior, the longwise channels are parallel to the longitudinal axis, wherein the channels are affixed to one another in a juxtapose manner position, with the plurality of channels extending continuously therethrough the primary interior from the first end portion to the second end portion. Wherein the channels are fluid permeable within the primary interior, the channels and the primary interior are all in fluid communication with one another and are also substantially sealed as against the external environment, such that the channels and the primary interior can have a portion of a fluid evacuated therethrough the second aperture into the external environment.

Also included in the encasement protective apparatus is a plurality of particulate items loosely disposed within each of the channels, each one of the channels are segmented such that the particulate items may not communicate as between each of the channels nor into the primary interior. The longwise channels form a continuous strata of the particulate items within the primary interior as between the first and second end portions and as between the first and second margin portions. Wherein operationally, when the channels and the primary interior have a portion of the fluid evacuated therethrough out the second aperture, creating an absolute pressure within the primary interior that is less than the absolute pressure in the external environment causing the primary interior to be compressed resulting in the apparatus being in an evacuated state being defined as when the particulate items are substantially in compressive contact with one another and also substantially immovable relative to one another. This results in the surrounding sidewall becoming rigidified to provide a rigid shell to protect the article. Further, the particulate items are relatively movable and loose relative to one another being defined as an un-evacuated state when the primary interior is equalized in absolute pressure with the external environment when the channels and the primary interior are un-evacuated therethrough the second aperture thereby placing the apparatus into the un-evacuated state allowing the sidewall to be pliable, facilitating the article to be taken from the pocket or disposed within the pocket therethrough the first aperture.

These and other objects of the present invention will become more readily appreciated and understood from a consideration of the following detailed description of the exemplary embodiments of the present invention when taken together with the accompanying drawings, in which;

BRIEF DESCRIPTION OF DRAWINGS

FIG. 10 shows a similar view to FIG. 1, wherein FIG. 10 shows a top plan view of the encasement protective apparatus or more particularly the protective case for the article with the apparatus surrounding sidewall folded over being substantially in the shape of a rectangular prism, with the side facing up that is opposite to the article adjacent side, further shown is the longitudinal axis, an optional handle and an auxiliary pocket for stowing the pump (not shown in this view), plus the first and second end portions, the first and second margins, and the outer surface of the surrounding sidewall;

FIG. 11 shows a similar view to FIG. 4, wherein FIG. 11 shows a top perspective view of the encasement protective apparatus or more particularly the protective case for the article with the apparatus surrounding sidewall folded over being substantially in the shape of a rectangular prism, as shown in the FIG. 10 top plan view, wherein in the FIG. 11 view shown is the first aperture with the means for removable engagement between the first and second margins that terminate in the attachments of the outer surface portion of the sidewall respectively at the first and second end portions forming the secondary interior in the shape of a pocket, further the means for removable engagement is shown partially engaged, wherein the placement of the article disposed within the pocket is shown being adjacent to the sidewall inner surface, further shown is the longitudinal axis, an optional handle and an auxiliary pocket for stowing the pump (not shown in this view), the second aperture and the valve that are both disposed within the auxiliary pocket, the first and second end portions, and the outer surface of the surrounding sidewall;

FIG. 12 shows a similar view to FIG. 11, wherein FIG. 12 shows a top perspective view of the encasement protective apparatus or more particularly the protective case for the article with the apparatus surrounding sidewall folded over being substantially in the shape of a rectangular prism, as shown in the FIG. 11 top plan view, wherein in the FIG. 12 view shown is the first aperture in a closed state with the means for removable engagement between the first and second margins also shown in a closed state that terminate in the attachments of the outer surface portion of the sidewall respectively at the first and second end portions, wherein the placement of the article disposed within the pocket is not shown, further shown is the longitudinal axis, an optional handle and an auxiliary pocket for stowing the pump, plus the second aperture and the valve that are both disposed within the auxiliary pocket, the first and second end portions, and the outer surface of the surrounding sidewall;

FIG. 14 shows a similar view to FIG. 11, wherein FIG. 14 shows a top perspective view of the encasement protective apparatus or more particularly the protective case for the article in the form of a long gun with the apparatus surrounding sidewall folded over being substantially in the shape of a rectangular prism, as shown in the FIG. 13 view, wherein in the FIG. 14 view shown is the first aperture with the means for removable engagement between the first and second margins that terminate in the attachments of the outer surface portion of the sidewall respectively at the first and second end portions forming the secondary interior in the shape of a pocket, further the means for removable engagement is shown partially engaged, wherein the placement of the article in the form of a long gun is disposed within the pocket is shown being adjacent to the sidewall inner surface, further shown is the longitudinal axis, an optional handle and an auxiliary pocket for stowing the pump (not shown in this view), the second aperture and the valve that are both disposed within the auxiliary pocket, the first and second end portions, and the outer surface of the surrounding sidewall.

REFERENCE NUMBERS IN DRAWINGS

Figure 1:
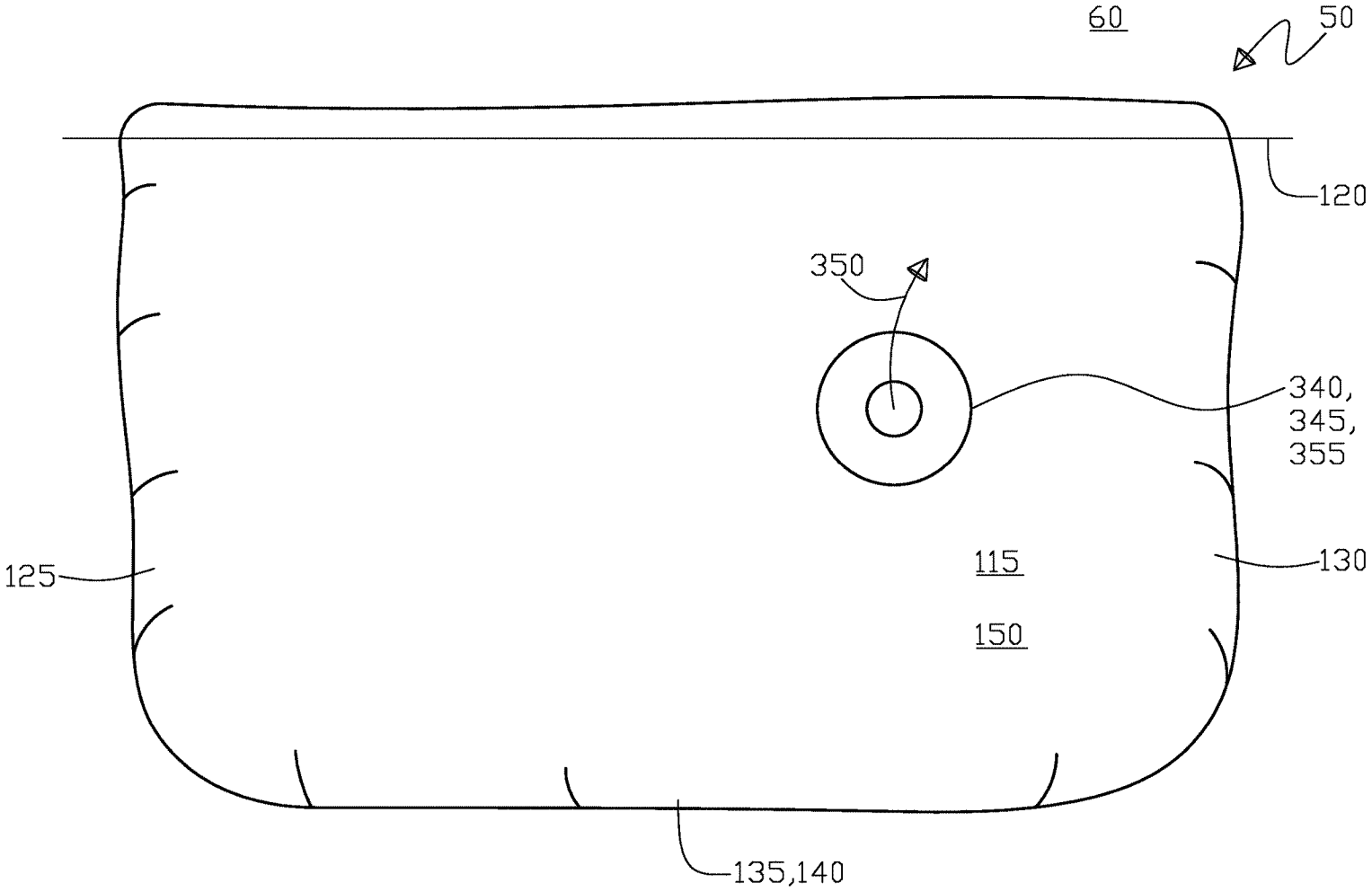
FIG. 1 shows a top plan view of the encasement protective apparatus or more particularly the protective case for the article with the apparatus surrounding sidewall folded over being substantially in the shape of a rectangular prism, with the side facing up that is opposite to the article adjacent side, further shown is the longitudinal axis, the second aperture, the valve, the first and second end portions, the first and second margins, and the outer surface of the surrounding sidewall.

50 Encasement protective apparatus
60 External environment
65 Article
75 Weapon
115 Flexible surrounding sidewall
120 Longitudinal axis of the surrounding sidewall 115
125 First end portion of the surrounding sidewall 115
130 Second end portion of the surrounding sidewall 115
135 First margin portion of the surrounding sidewall 115
140 Second margin portion of the surrounding sidewall 115
145 Inner surface portion of the surrounding sidewall 115
150 Outer surface portion of the surrounding sidewall 115
155 Attachment of outer surface portion 150 at the first 125 and second 130 end portions
160 Primary interior of the surrounding sidewall 115
165 Pocket formed from attachment 155
170 Secondary interior formed by the pocket 165
175 Plurality of flexible longwise channels
176 Interior of channel 175
180 Parallel position of the flexible longwise channels 175 to the longitudinal axis 120
185 Channels 175 affixed or attached to one another in a juxtapose manner
190 Fluid communication between the channels 175 within the primary interior 160
285 Plurality of open spaces without the particulate items 300
300 Particulate items
305 Continuous strata of particulate items 300 as formed within the primary interior 160 as between the first 125 and second 130 end portions and between the first 135 and second 140 margin portions
310 Non-symmetrical outer surface of the particulate items 300
315 Means for removable engagement between the first 135 and second 140 margin end portions
320 Engaged operational state of the means for removable engagement 315
325 Disengaged operational state of the means for removable engagement 315
330 First aperture opening defined by the means 315
340 Second aperture disposed therethrough the surrounding sidewall 115
345 Valve disposed in the second aperture 340
350 Fluid communication flow therethrough the valve 345
355 Open state of valve 345 allowing fluid flow therethrough 350
360 Evacuated state of particulate items 300 and the open spaces 285
380 Un-evacuated state of particulate items 300 and the open spaces 285
385 Enveloping the article 65 with the surrounding sidewall 115
400 Fluid permeable retention mat
401 Filled interior of the channel interior 176
402 Open interior of the channel interior 176
410 Handles
411 Affixment of the handles 410 to the outer surface 150 of the surrounding sidewall 115
420 Auxiliary pocket
421 Affixment of the auxiliary pocket 420 to the outer surface 150 of the surrounding sidewall 115
430 Pump

DETAILED DESCRIPTION

Figure 2:
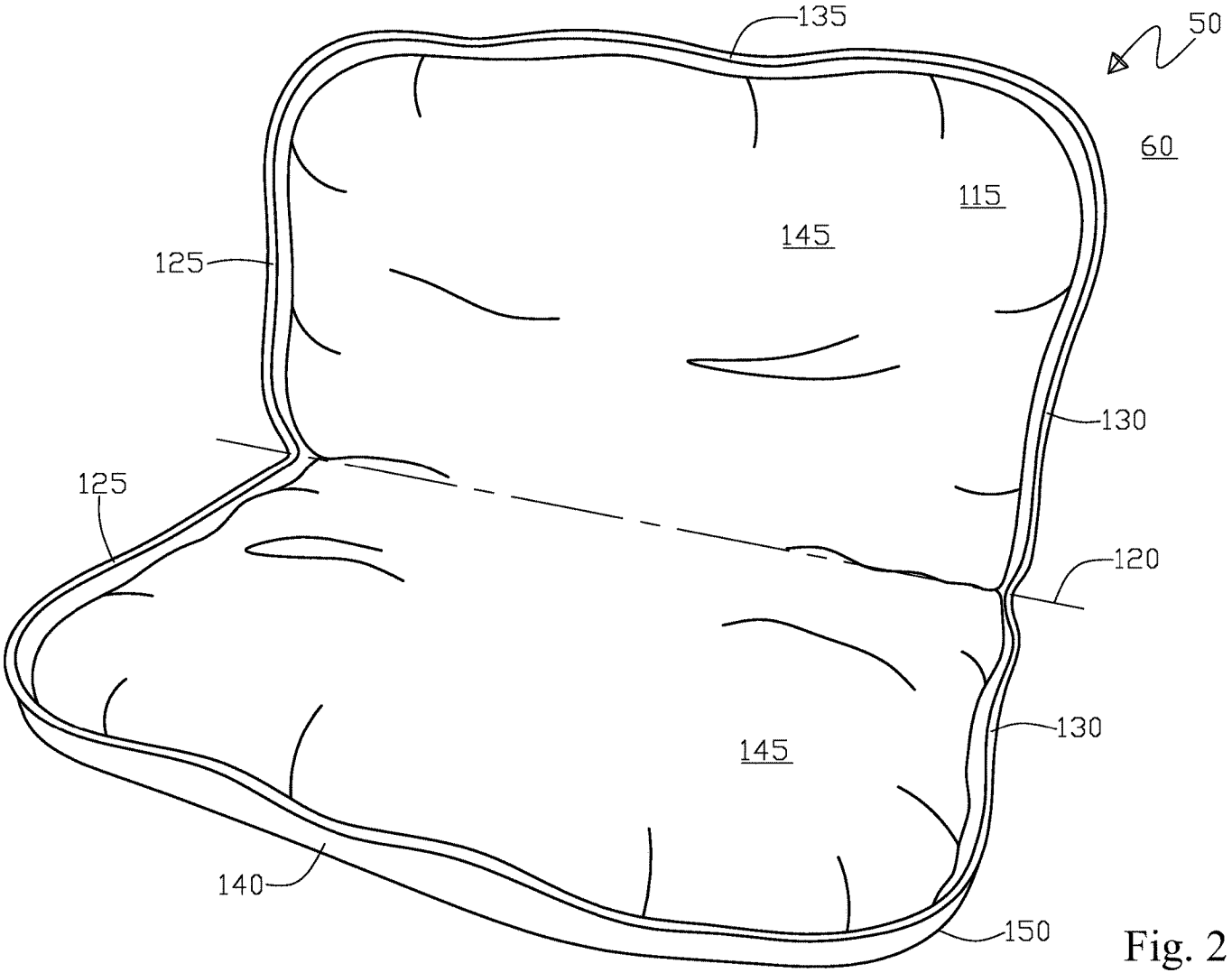
FIG. 2 shows an opened up perspective view of FIG. 1, wherein the sidewall is shown with the inner surface of the sidewall, further shown is the longitudinal axis, the first and second end portions, plus the first and second margins.

With initial reference to FIG. 1 shown is a top plan view of the encasement protective apparatus 50 or more particularly the protective case 50 for the article 65 with the apparatus 50 surrounding sidewall 115 folded over being substantially in the shape of a rectangular prism, with the side facing up that is opposite to the article 65 adjacent side, further shown is the longitudinal axis 120, the second aperture 340, the valve 345, the first 125 and second 130 end portions, the first 135 and second 140 margins, and the outer surface 150 of the surrounding sidewall 115. Next, FIG. 2 shows an opened up perspective view of FIG. 1, wherein the sidewall 115 is shown, the inner surface 145 of the sidewall 115, plus further shown is the longitudinal axis 120, the first 125 and second 130 end portions, plus the first 135 and second 140 margins.

Figure 3:
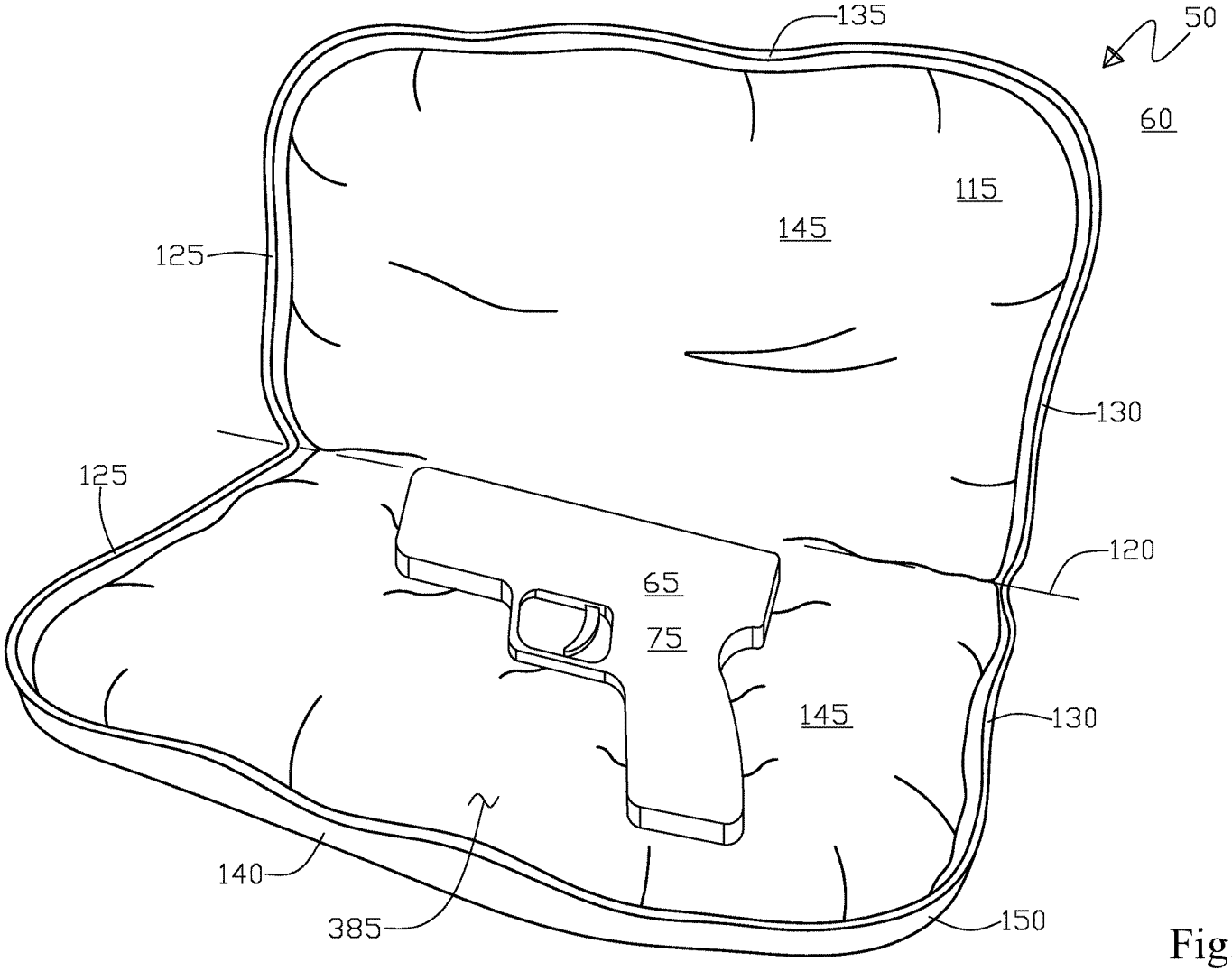
FIG. 3 also shows an opened up perspective view of FIG. 1, giving the ability to see the placement of the article disposed within the sidewall inner surface, again shown is the longitudinal axis, the first and second end portions, plus the first and second margins.
Figure 4:
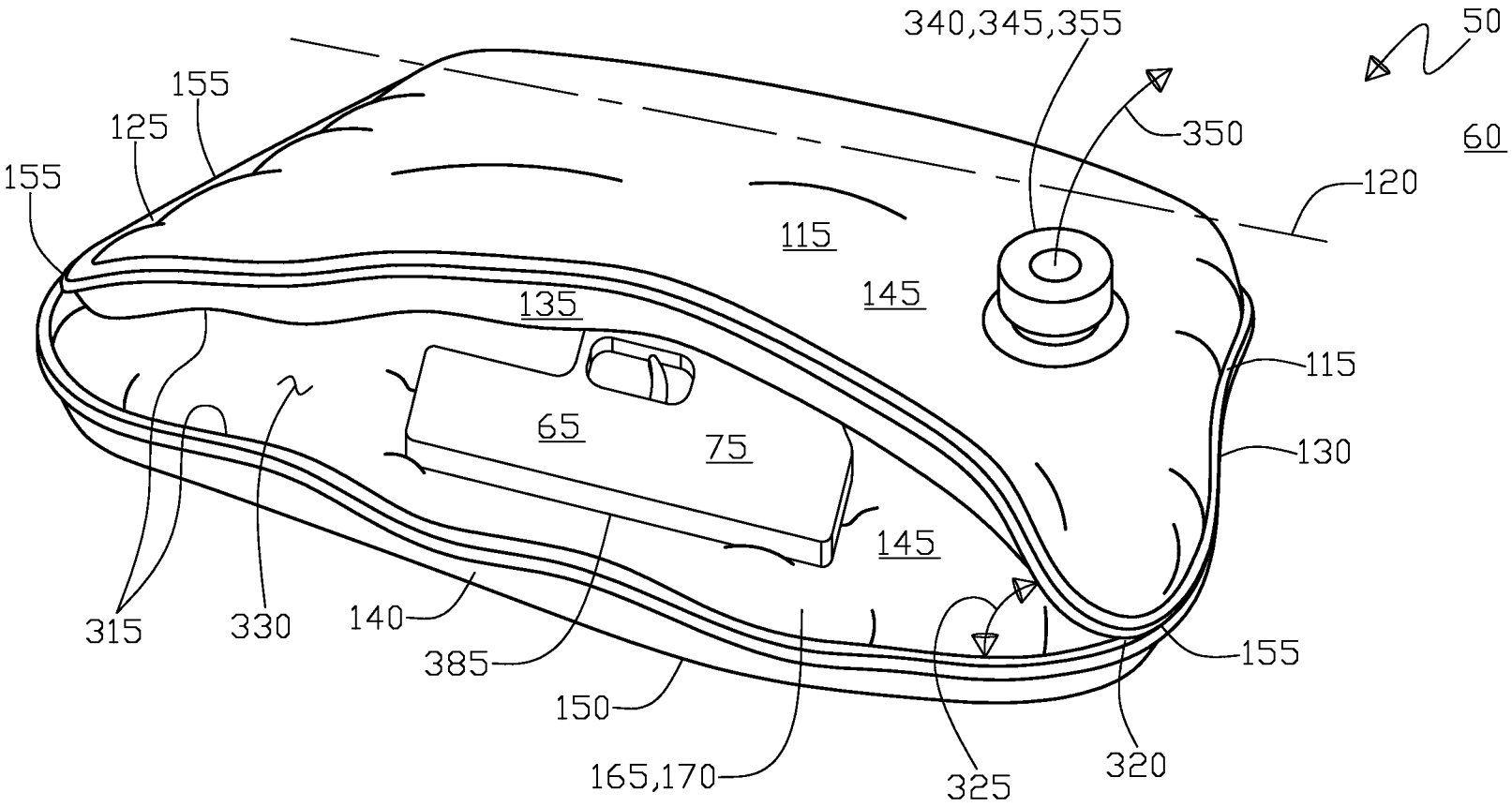
FIG. 4 shows a top perspective view of the encasement protective apparatus or more particularly the protective case for the article with the apparatus surrounding sidewall folded over being substantially in the shape of a rectangular prism, as shown in the FIG. 1 top plan view, wherein in the FIG. 4 view shown is the first aperture with the means for removable engagement between the first and second margins that terminate in the attachments of the outer surface portion of the sidewall respectively at the first and second end portions forming the secondary interior in the shape of a pocket, further the means for removable engagement is shown partially engaged, wherein the placement of the article disposed within the pocket is shown being adjacent to the sidewall inner surface, further shown is the longitudinal axis, the second aperture, the valve, the first and second end portions, and the outer surface of the surrounding sidewall.

Continuing, FIG. 3 also shows an opened up perspective view of FIG. 1, giving the ability to see the placement of the article 65 disposed within the sidewall 115 inner surface 145, again shown is the longitudinal axis 120, the first 125 and second 130 end portions, plus the first 135 and second 140 margins. Moving ahead, FIG. 4 shows a top perspective view of the encasement protective apparatus 50 or more particularly the protective case 50 for the article 65 with the apparatus surrounding sidewall 115 folded over being substantially in the shape of a rectangular prism, as shown in FIG. 1 top plan view. Wherein, in the FIG. 4 view the first aperture 330 with the means 315 for removable engagement between the first 135 and second 140 margins that terminate in the attachments 155 of the outer surface portion 150 of the sidewall 115 respectively at the first 125 and second 130 end portions forming the secondary interior 170 in the shape of a pocket 165, further the means 315 for removable engagement is shown partially engaged. Wherein FIG. 4 also shows the placement of the article 65 disposed within the pocket 165 enveloping 85 the article 65 within the sidewall 115, as the article 65 is shown being adjacent to the sidewall 115 inner surface 145, further shown is the longitudinal axis 120, the second aperture 340, the valve 345, the first 125 and second 130 end portions, and the outer surface 150 of the surrounding sidewall 115.

Figure 5:
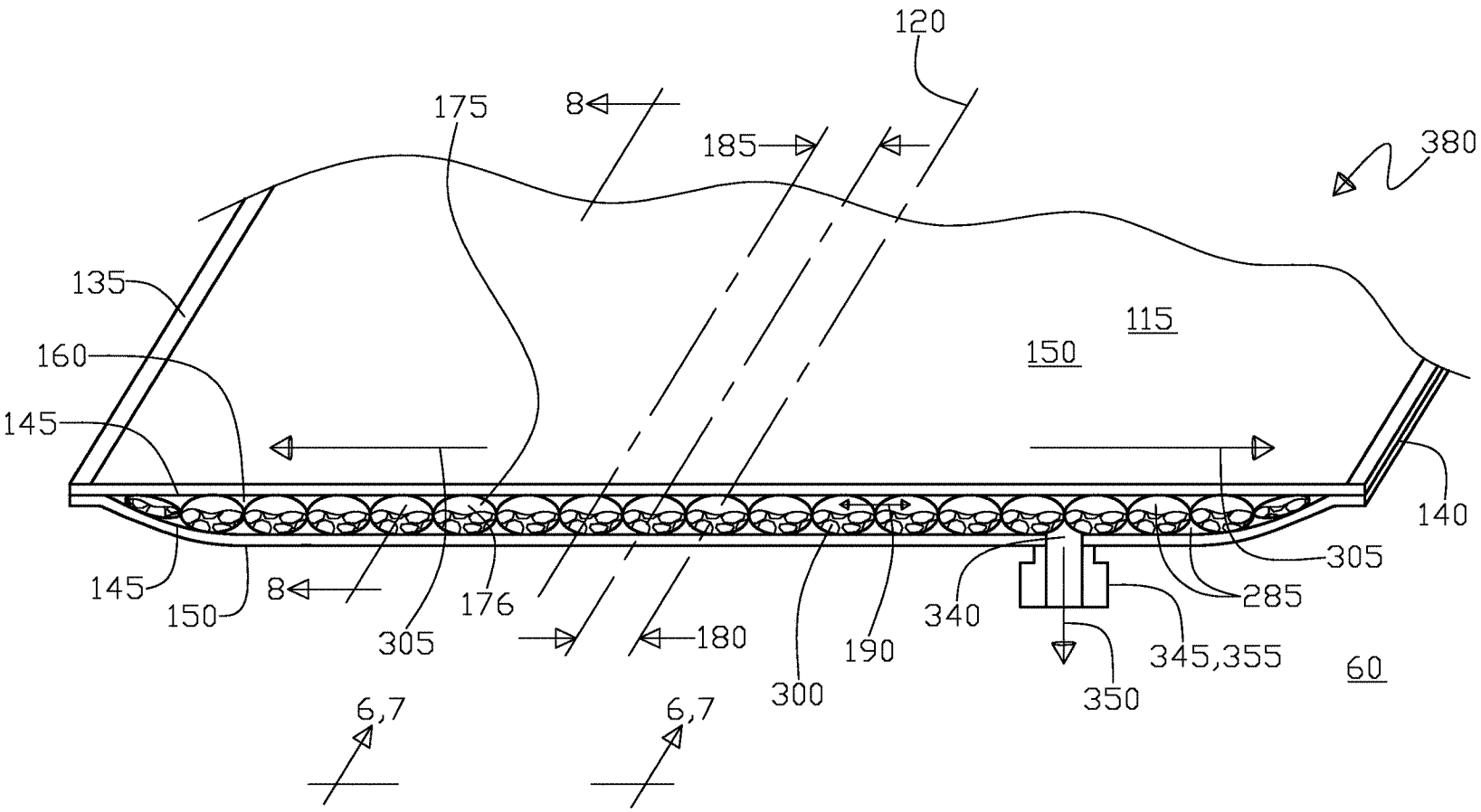
FIG. 5 shows cross section cut 5-5 from FIG. 9 showing the cross section of the primary interior of the surrounding sidewall, with the outer surface and inner surface of the sidewall, wherein the plurality of flexible longwise channels are cross sectioned perpendicular to their longwise orientation being with each channel attached juxtapose to one another and parallel to the longitudinal axis, with each channel containing the particulate items, the portion of the primary interior open spaces as between the channels without the particulate items, the fluid communication between the channels within the primary interior, the continuous strata of particulate items, the second aperture, the valve, the fluid communication therethrough the valve, plus the first and second margin portions.
Figure 9:
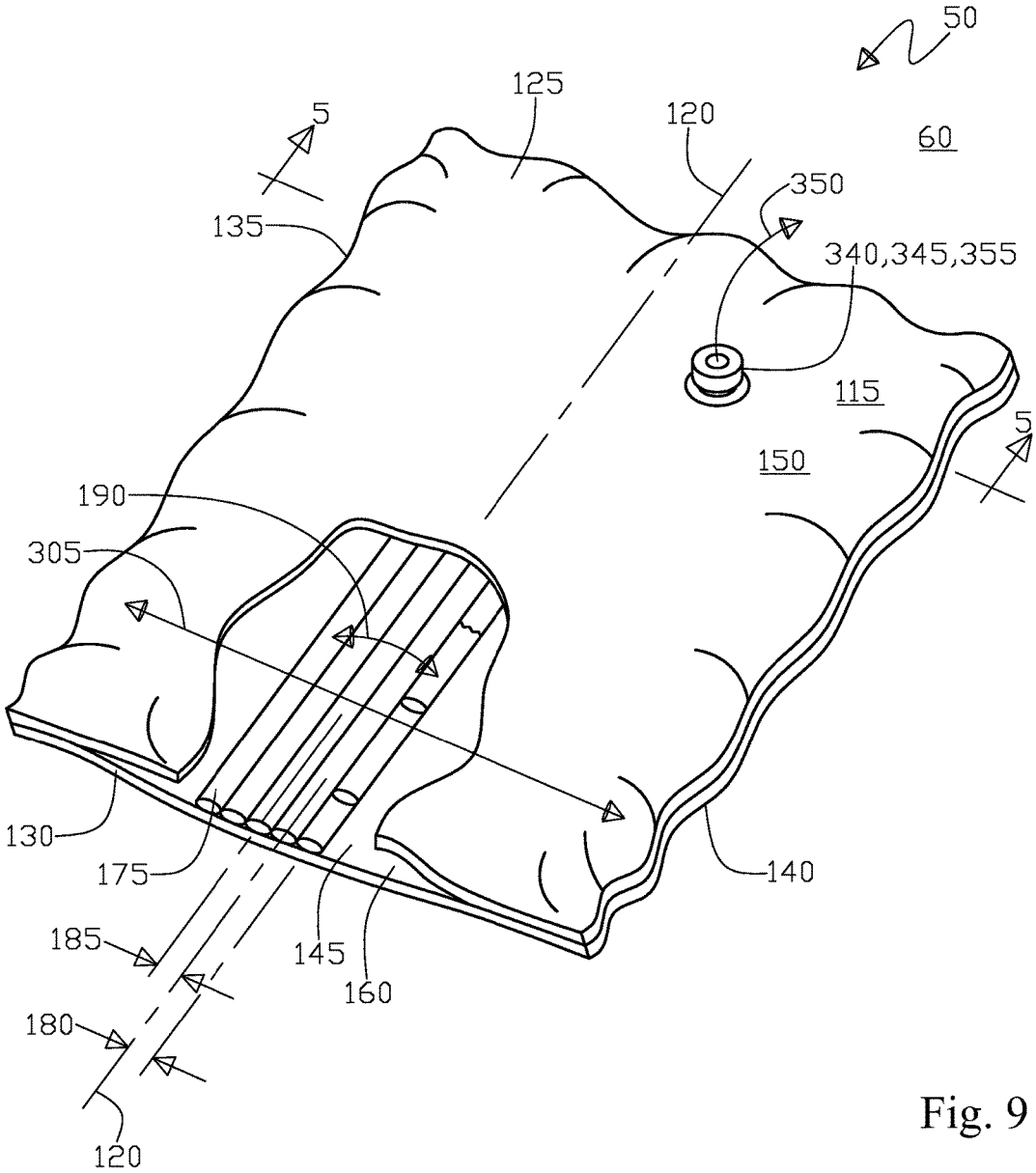
FIG. 9 shows a flat plan view of the encasement protective apparatus or more particularly the protective case for the article with the apparatus surrounding sidewall laid out flat being substantially in the shape of a rectangular prism, with the side facing up that is opposite to the article adjacent side, further shown is the longitudinal axis, the first and second end portions, the first and second margins, the outer surface of the surrounding sidewall, further a cut-out shows the primary interior of the surrounding sidewall, with the outer surface and inner surface of the sidewall, wherein the plurality of flexible longwise channels are shown with each channel attached juxtapose to one another and parallel to the longitudinal axis, the fluid communication between the channels within the primary interior, the continuous strata of particulate items, the second aperture, the valve, and the fluid communication therethrough the valve.

Next, FIG. 5 shows cross section cut 5-5 from FIG. 9 showing the cross section of the primary interior 160 of the surrounding sidewall 115, with the outer surface 150 and inner surface 145 of the sidewall 115, wherein the plurality of flexible longwise channels 175 are cross sectioned perpendicular to their longwise orientation with each channel 175 attached 185 juxtapose to one another and parallel 180 to the longitudinal axis 120, with each channel 175 containing the particulate items 300. Also, in FIG. 5 shown is the portion of the primary interior 160 open spaces 285 as between the channels 175 and within the channels 175 without the particulate items 300, the fluid communication 190 between the channels 175 within the primary interior 160, the continuous strata 305 of particulate items 300, the second aperture 340, the valve 345, the fluid communication 350 therethrough the valve 345, plus the first 135 and second 140 margin portions.

Figure 6:
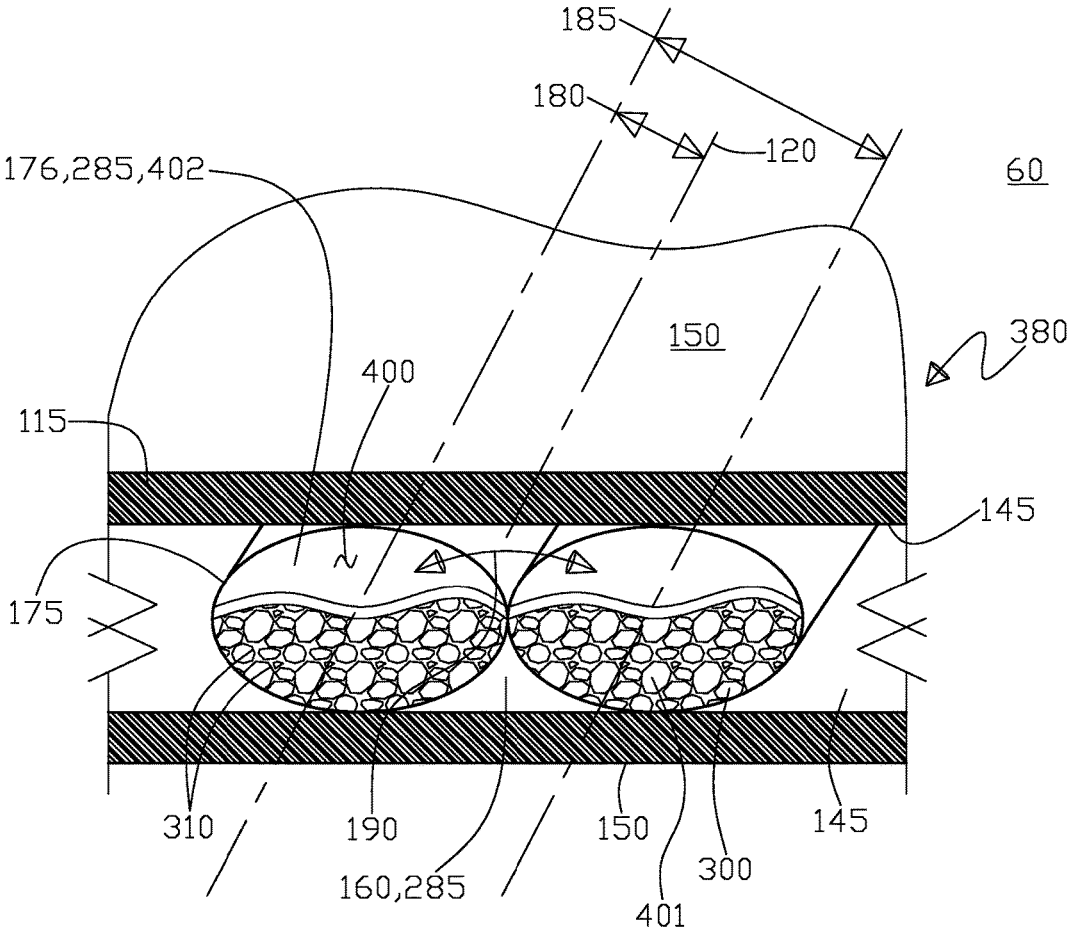
FIG. 6 is a close up view 6-6 of FIG. 5, showing in particular the primary interior of the surrounding sidewall with the inner and outer surfaces of the sidewall, wherein the plurality of flexible longwise channels showing each channel being attached juxtapose to one another and parallel to the longitudinal axis, also with each channel containing the particulate items, the portion if the primary interior open spaces as between the channels and within the channels without the particulate items, the fluid communication between the channels within the primary interior, with the particulate items shown in the un-evacuated state being loose relative to one another being loosely held in place with a fluid permeable retention mat.

Moving onward, FIG. 6 is a close up view 6-6 of FIG. 5, showing in particular the primary interior 160 of the surrounding sidewall 115 with the inner 145 and outer 150 surfaces of the sidewall 115, wherein the plurality of flexible longwise channels 175 wherein each channel is attached 185 juxtapose to one another and parallel 180 to the longitudinal axis 120. Also, FIG. 6 shows each channel 175 containing the particulate items 300, the portion of the primary interior open spaces 285 as between the channels 175 and within the channels 175 without the particulate items 300, the fluid communication 190 between the channels 175 within the primary interior 160, with the particulate items 300 shown in the un-evacuated state 380 being loose relative to one another, being loosely held in place with a fluid permeable retention mat 400.

Figure 7:
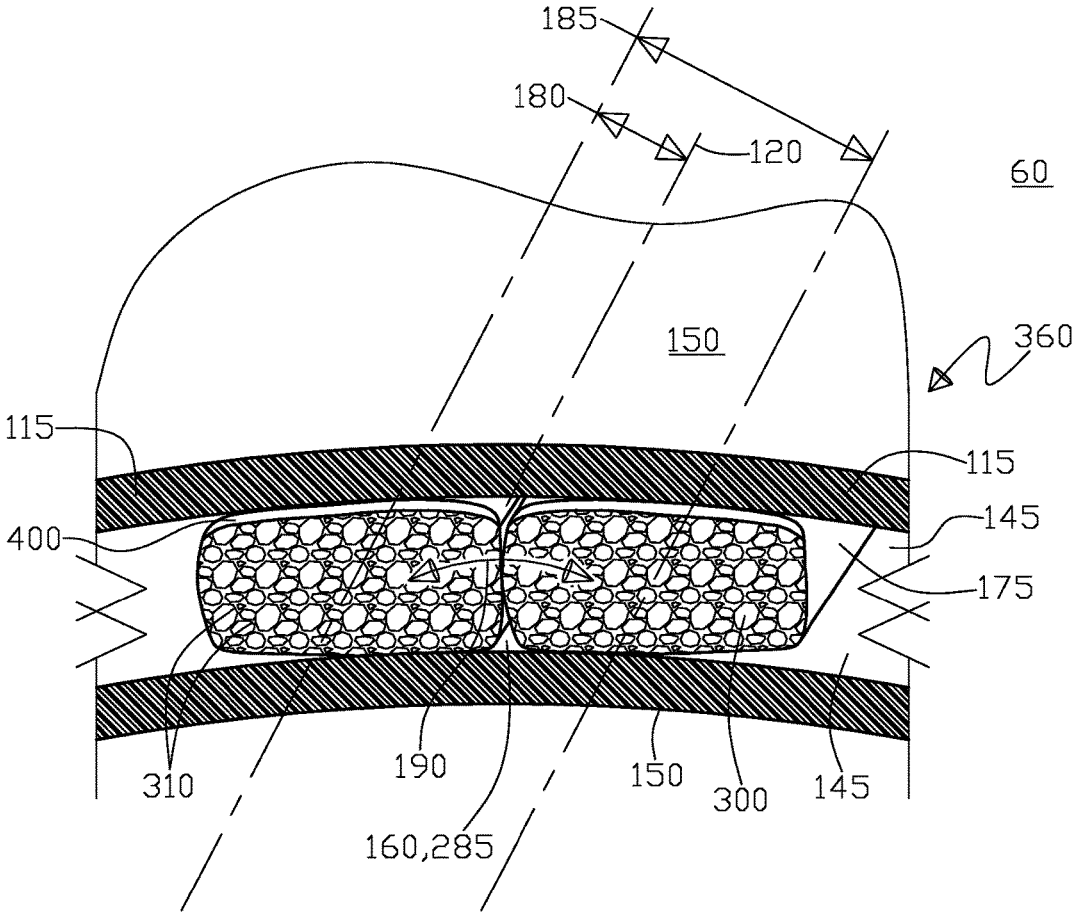
FIG. 7 is a close up view 7-7 of FIG. 5, showing in particular the primary interior of the surrounding sidewall with the inner and outer surfaces of the sidewall, wherein the plurality of flexible longwise channels are shown with each channel attached juxtapose to one another and parallel to the longitudinal axis, also with each channel containing the particulate items, the portion if the primary interior open spaces as between the channels without the particulate items, the fluid communication between the channels within the primary interior, with the particulate items shown in the evacuated state being in compressed rigid contact relative to one another with the fluid permeable retention mat in position.

Further, FIG. 7 is a close up view 7-7 of FIG. 5, showing in particular the primary interior 160 of the surrounding sidewall 115 with the inner 145 and outer 150 surfaces of the sidewall 115, wherein the plurality of flexible longwise channels 175 are shown with each channel 175 attached 185 juxtapose to one another and parallel 180 to the longitudinal axis 120. Again in FIG. 7 with each channel 175 containing the particulate items 300, the portion of the primary interior 160 open spaces 285 as between the channels 175 and within the channels 175 without the particulate items 300, the fluid communication 190 between the channels 175 within the primary interior 160, with the particulate items 300 shown in the evacuated state 360 being in compressed rigid contact relative to one another with the fluid permeable retention mat 400 in position.

Figure 8:
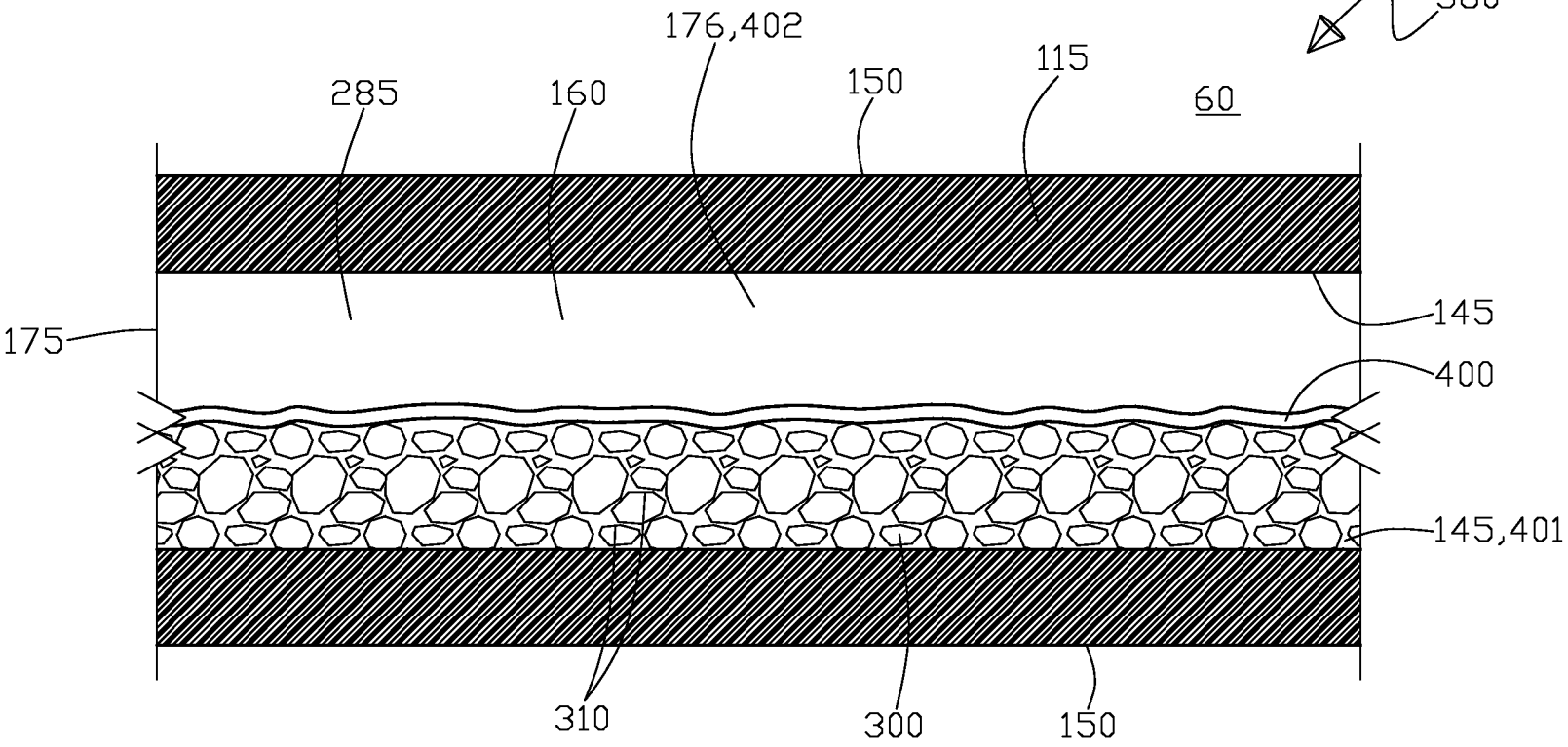
FIG. 8 shows cross section 8-8 from FIG. 5 being a longitudinal or longwise cross section of the surrounding sidewall showing in particular the primary interior of the surrounding sidewall with the inner and outer surfaces of the sidewall, showing a single flexible longwise channel, also with the channel containing the particulate items, the portion of the primary interior open spaces and within the channel without the particulate items, with the particulate items shown in the un-evacuated state being loose relative to one another, with the fluid permeable retention mat in position.

Continuing, FIG. 8 shows cross section 8-8 from FIG. 5 being a longitudinal or longwise cross section of the surrounding sidewall 115 showing in particular the primary interior 160 of the surrounding sidewall 115 with the inner 145 and outer 150 surfaces of the sidewall 115. With FIG. 8 showing a single flexible longwise channel 175, also with the channel 175 containing the particulate items 300, the portion if the primary interior 160 open spaces 285 and within the channel 175 without the particulate items 300, with the particulate items 300 shown in the un-evacuated state 380 being loose relative to one another with the fluid permeable retention mat 400 in position.

Moving ahead, FIG. 9 shows a flat plan view of the encasement protective apparatus 50 or more particularly the protective case 50 for the article 65 with the apparatus 50 surrounding sidewall 115 laid out flat being substantially in the shape of a rectangular prism, with the side facing up that is opposite to the article 65 adjacent side. Further shown in FIG. 9 is the longitudinal axis 120, the first 125 and second 130 end portions, the first 135 and second 140 margins, the outer surface 150 of the surrounding sidewall 115. Further, in FIG. 9, a cut-out shows the primary interior 160 of the surrounding sidewall 115, with the outer surface 150 and inner surface 145 of the sidewall 115, wherein the plurality of flexible longwise channels 175 are shown with each channel attached 185 juxtapose to one another and parallel 180 to the longitudinal axis 120, the fluid communication 190 between the channels 175 within the primary interior 160, the continuous strata 305 of particulate items 300, the second aperture 340, the valve 345, and the fluid communication 350 therethrough the valve 345.

Figure 10:
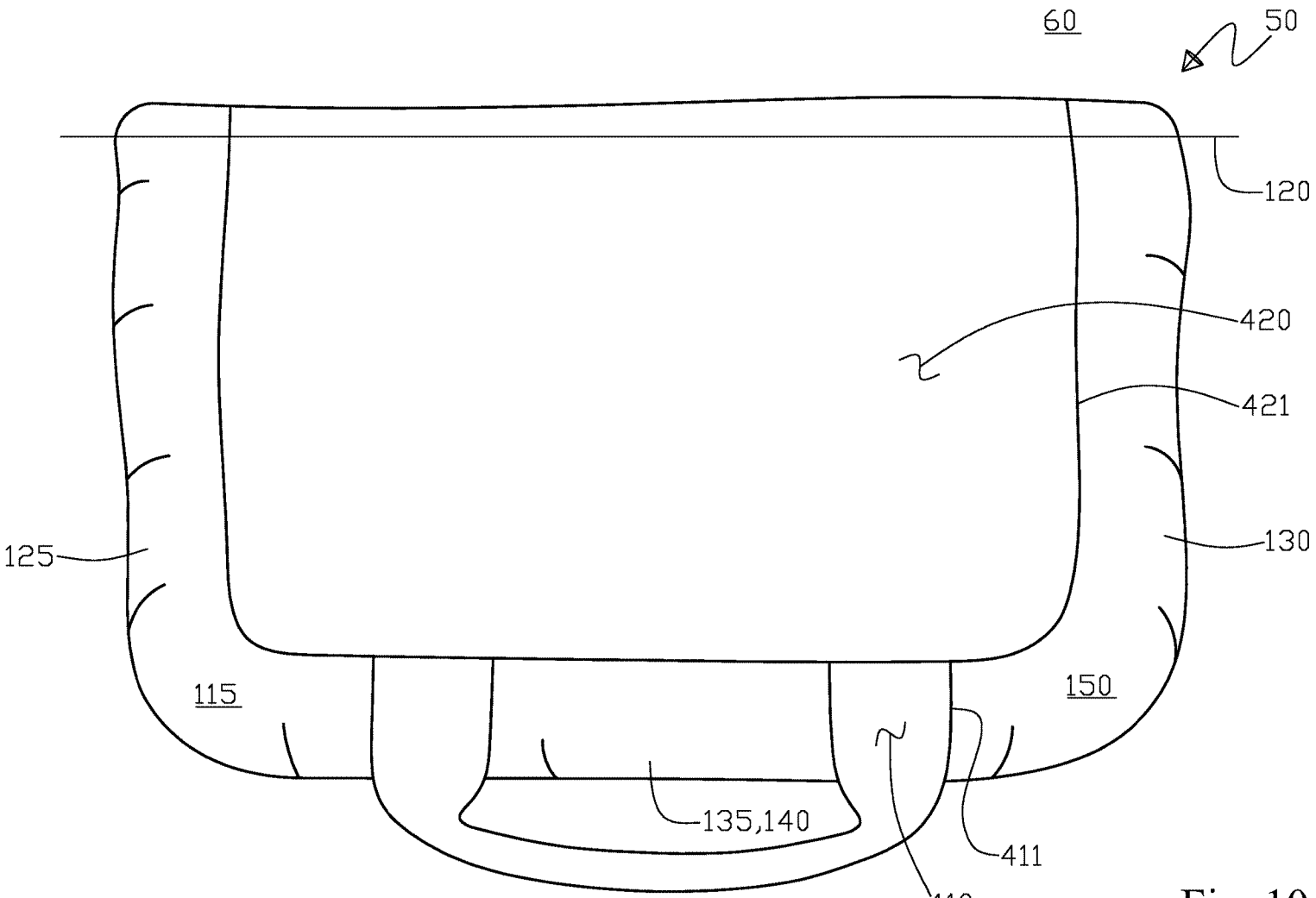

Next, in FIG. 10 shows a similar view to FIG. 1, wherein FIG. 10 shows a top plan view of the encasement protective apparatus 50 or more particularly the protective case 50 for the article 65 with the apparatus 50 surrounding sidewall 115 folded over being substantially in the shape of a rectangular prism, with the side facing up that is opposite to the article 65 adjacent side, further shown is the longitudinal axis 120, an optional handle 410 and an auxiliary pocket 420 for stowing the pump 430 (not shown in this view), plus the first 125 and second 130 end portions, the first 135 and second 140 margins, and the outer surface 150 of the surrounding sidewall 115.

Figure 11:
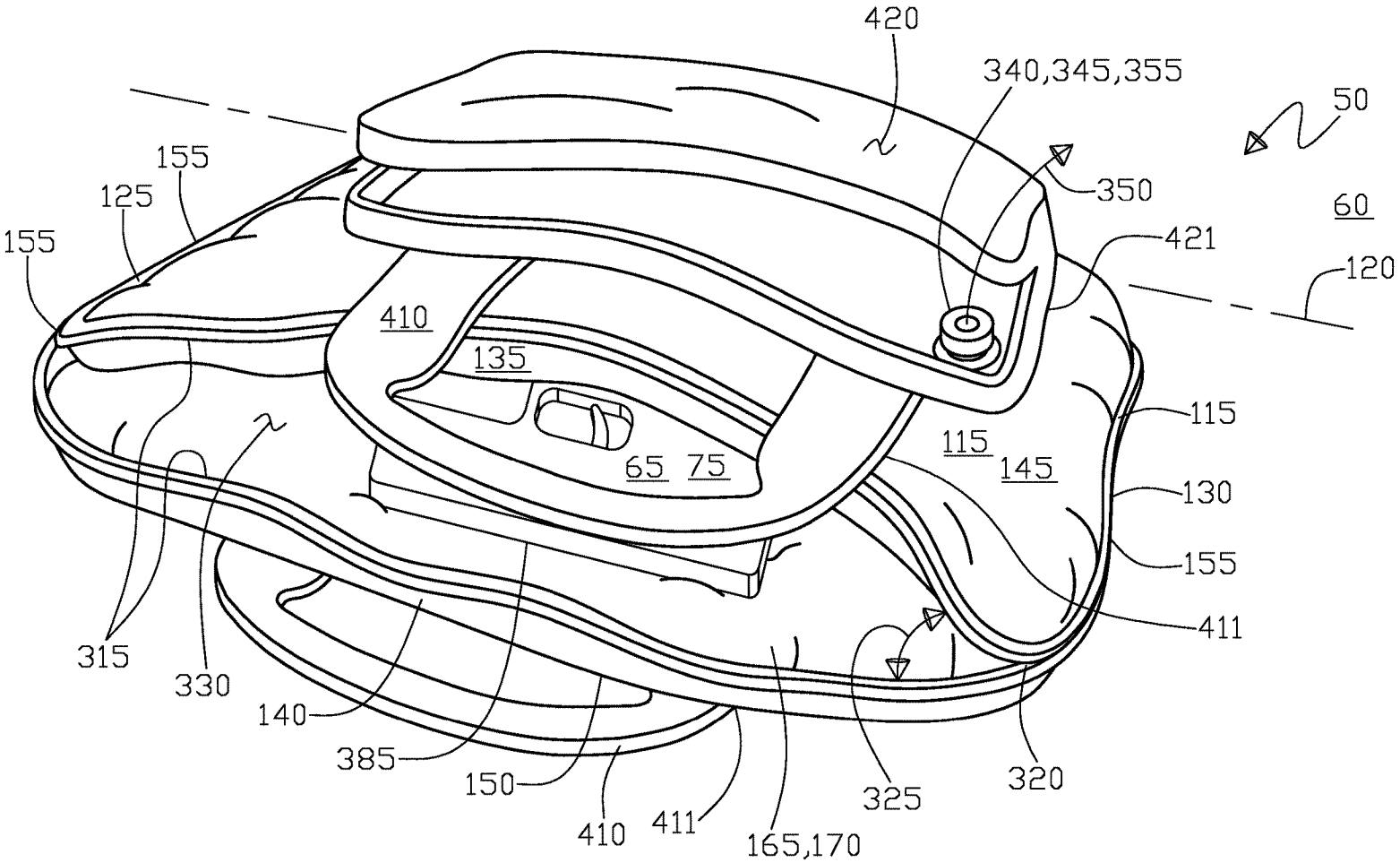

Continuing, FIG. 11 shows a similar view to FIG. 4, wherein FIG. 11 shows a top perspective view of the encasement protective apparatus 50 or more particularly the protective case 50 for the article 65 with the apparatus 50 surrounding sidewall 115 folded over being substantially in the shape of a rectangular prism, as shown in the FIG. 10 top plan view, wherein in the FIG. 11 view shown is the first aperture 330 with the means 315 for removable engagement between the first 135 and second 140 margins that terminate in the attachments 155 of the outer surface portion 150 of the sidewall 115 respectively at the first 125 and second 130 end portions forming the secondary interior 170 in the shape of a pocket 165. Also FIG. 11 shows further the means 315 for removable engagement is shown partially engaged, wherein the placement of the article 65 disposed within the pocket 165 is shown being adjacent to the sidewall 115 inner surface 145, further shown is the longitudinal axis 120, an optional handle 410 and an auxiliary pocket 420 for stowing the pump 430 (not shown in this view), the second aperture 340 and the valve 345 that are both disposed within the auxiliary pocket 420, the first 125 and second 130 end portions, and the outer surface 150 of the surrounding sidewall 115.

Figure 12:
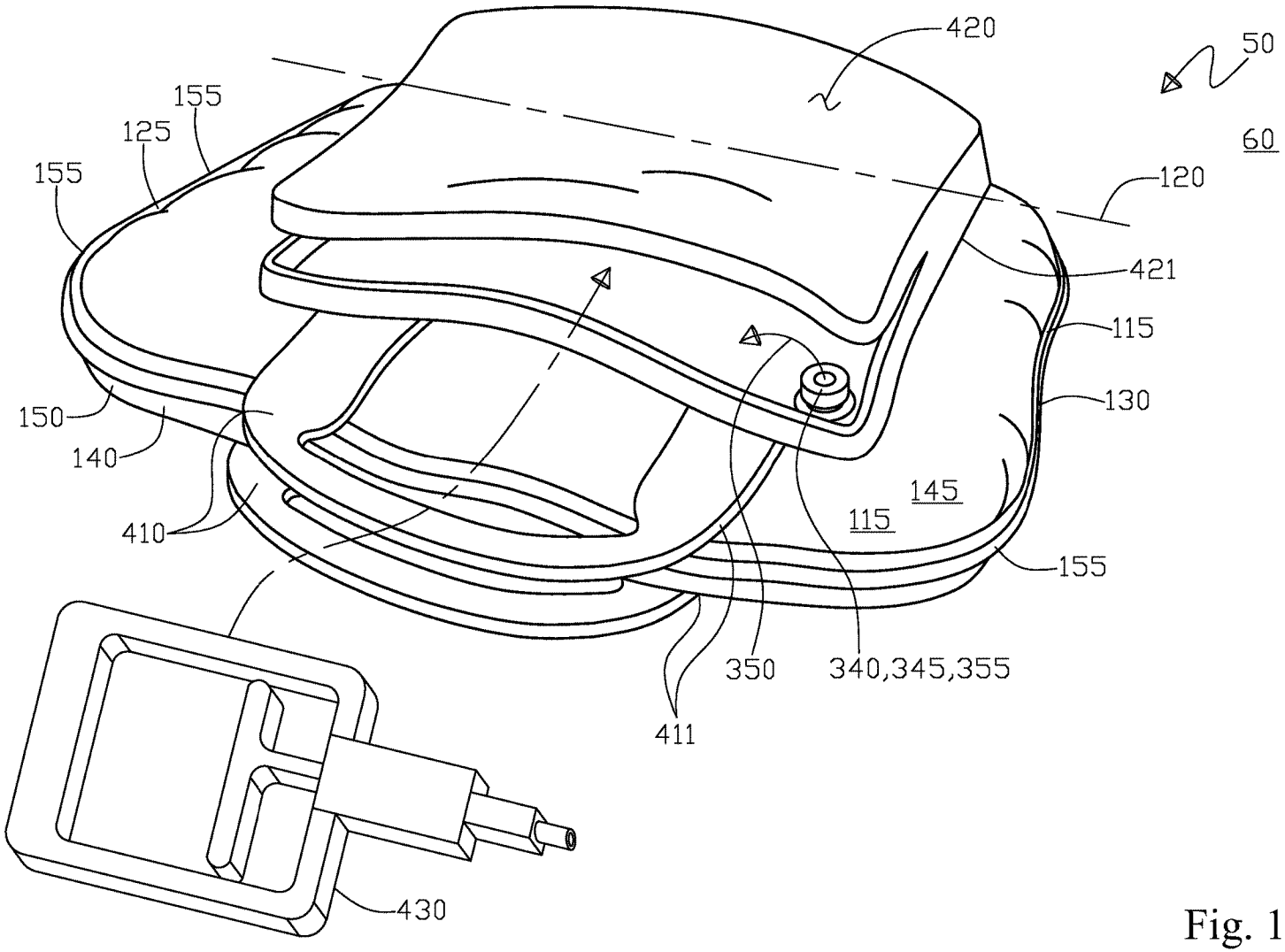

Next, FIG. 12 shows a similar view to FIG. 11, wherein FIG. 12 shows a top perspective view of the encasement protective apparatus 50 or more particularly the protective case 50 for the article 65 with the apparatus surrounding sidewall 115 folded over being substantially in the shape of a rectangular prism, as shown in the FIG. 11 top plan view, wherein in the FIG. 12 view shown is the first aperture 330 in a closed state with the means 315 for removable engagement between the first 135 and second 140 margins also shown in a closed state that terminate in the attachments 155 of the outer surface portion 150 of the sidewall 115 respectively at the first 125 and second 130 end portions. Further, FIG. 12 shows the placement of the article 65 disposed within the pocket 165 is not shown, further shown is the longitudinal axis 120, an optional handle 410 and an auxiliary pocket 420 for stowing the pump 430, plus the second aperture 340 and the valve 345 that are both disposed within the auxiliary pocket 420, the first 125 and second 130 end portions, and the outer surface 150 of the surrounding sidewall 115.

Figure 13:
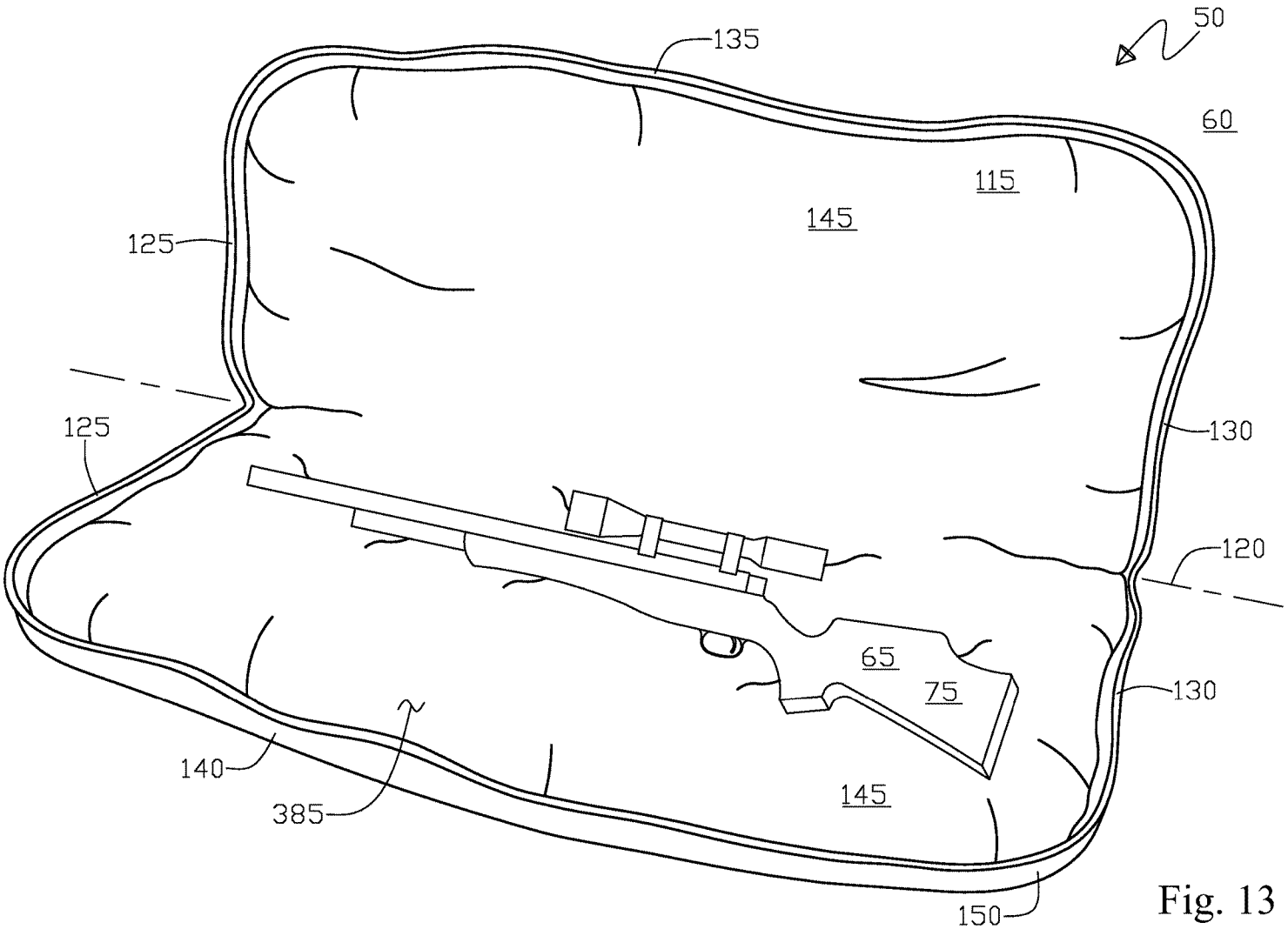
FIG. 13 shows a similar view to FIG. 3, wherein FIG. 13 giving the ability to see the placement of the article in the form of a long gun disposed within the sidewall inner surface, again shown is the longitudinal axis, the first and second end portions, plus the first and second margins.

Moving ahead, FIG. 13 shows a similar view to FIG. 3, wherein FIG. 13 giving the ability to see the placement of the article 65 in the form of a long gun disposed within the sidewall 115 inner surface 145, again shown is the longitudinal axis 120, the first 125 and second 130 end portions, plus the first 135 and second 140 margins.

Figure 14:
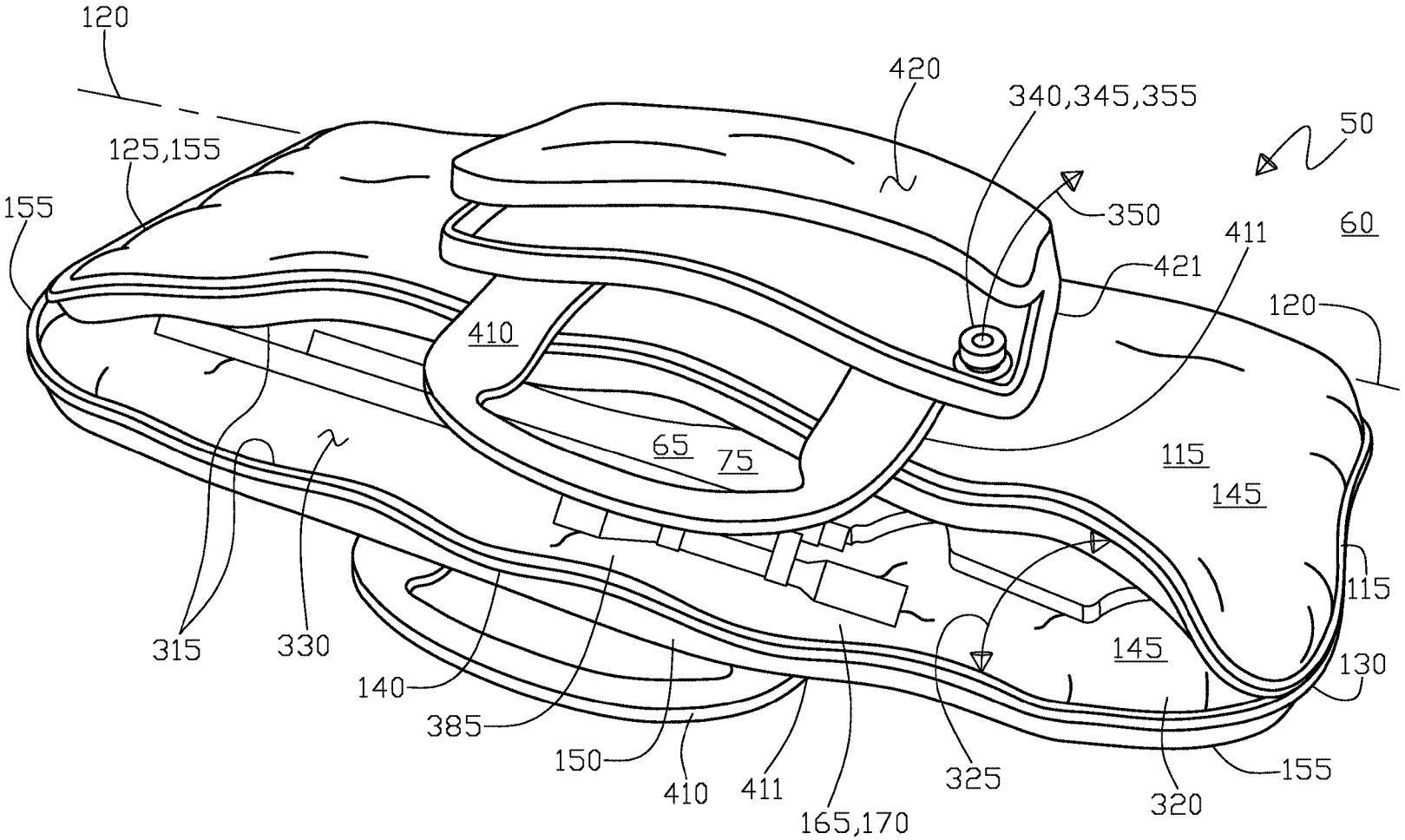

Further, FIG. 14 shows a similar view to FIG. 11, wherein FIG. 14 shows a top perspective view of the encasement protective apparatus 50 or more particularly the protective case 50 for the article 65 in the form of a long gun with the apparatus 50 surrounding sidewall 115 folded over being substantially in the shape of a rectangular prism, as shown in the FIG. 13 view, wherein in the FIG. 14 view shown is the first aperture 330 with the means 315 for removable engagement between the first 135 and second 140 margins that terminate in the attachments 155 of the outer surface portion 150 of the sidewall 115 respectively at the first 125 and second 130 end portions forming the secondary interior 170 in the shape of a pocket 165. Further, in FIG. 14 the means 315 for removable engagement is shown partially engaged, wherein the placement of the article 65 in the form of a long gun is disposed within the pocket 165 is shown being adjacent to the sidewall 115 inner surface 145, further shown is the longitudinal axis 120, an optional handle 410 and an auxiliary pocket 420 for stowing the pump 430 (not shown in this view), the second aperture 340 and the valve 345 that are both disposed within the auxiliary pocket 420, the first 125 and second 130 end portions, and the outer surface 150 of the surrounding sidewall 115.

Broadly, in referring to FIGS. 1 to 14, the present invention is of the encasement protective apparatus 50 for enveloping the article 65 or weapon 75 as is shown in FIGS. 3 and 4, wherein the encasement protective apparatus 50 includes the flexible surrounding sidewall 115 that is substantially fluid tight about the longitudinal axis 120, wherein the surrounding sidewall 115 has the substantially fluid tight first end portion 125 and the opposing substantially fluid tight second end portion 130, with the longitudinal axis 120 spanning therebetween, see FIGS. 2, 3, and 9, in particular. The surrounding sidewall 115 also having the substantially fluid tight first margin portion 135 and the opposing substantially fluid tight second margin portion 140, wherein the first 135 and second 140 margin portions are substantially parallel to the longitudinal axis 120, see FIGS. 2, 3, 4, and 9, the surrounding sidewall 115 also having the outer surface 150 portion that is adjacent to an external environment 60 and the inner surface portion 145 that defines the primary interior 160 formed by the sidewall 115, see FIGS. 4 to 9. As the primary interior is defined by the first 125 and second 130 end portions and the first 135 and second 140 margins, and the inner surface 145 of the sidewall 115, again see FIGS. 4 to 9.

Wherein, the outer surface portion 150 is attached 155 at the first 125 and second 130 end portions thus, forming the pocket 165 that the article 65 is disposed within, see FIGS. 3 and 4. With the first 135 and second 140 margin portions at the outer surface 150 being removably engagable via means 315 to one another and that define the first aperture 330 opening, with the means 315 being preferably a zipper or an equivalent, see in particular FIG. 4. Further the means 315 has an engaged operational state 320 and a disengaged operational state 325, see FIG. 4. Wherein, the pocket 165 defining the secondary interior 170, again see FIG. 4. Further, the second aperture 340 is disposed therethrough the sidewall 115 allowing fluid communication 350 from the primary interior 160 into the external environment 60 and from the external environment 60 to the primary interior 160.

Further included in the encasement protective apparatus 50 are the plurality of flexible longwise channels 175 disposed within the primary interior 160, the longwise channels 175 are parallel 180 to the longitudinal axis 120, wherein the channels 175 are affixed 185 to one another in a juxtapose manner position, with the plurality of channels 175 extending continuously therethrough the primary interior 160 from the first end portion 125 to the second end portion 130, wherein each channel has an interior 176, see FIGS. 5 to 9. Wherein the channels 175 are fluid permeable within the primary interior 160, the channels 175 and the primary interior 160 are all in fluid communication 190 with one another and are also substantially sealed as against the external environment 60, see FIGS. 6 to 9, such that the channels 175 and the primary interior 160 can have a portion of a fluid, preferably being atmospheric air within the primary interior 160 evacuated or communicated 350 therethrough the second aperture 340 into the external environment 60, see FIGS. 1, 4, 5, 6, 9, 11, 12, and 14.

Also included in the encasement protective apparatus 50 is the plurality of particulate items 300 loosely disposed within each of the channels 175, wherein the particulate items 300 have a non-symmetrical outer surface 310, wherein each one of the channels 175 are segmented such that the particulate items 300 may not communicate as between each of the channels 175 nor into the primary interior 160, see FIGS. 5 to 8. The longwise channels 175 form the continuous strata 305 of the particulate items 300 within the primary interior 160 as between the first 125 and second 130 end portions and as between the first 135 and second 140 margin portions, via being disposed within the channel interior 176, see FIGS. 5, 6, and 9. Wherein operationally, looking at FIGS. 1, 4, 5, 7, and 9, when the channels 175 and the primary interior 160 have a portion of the fluid evacuated or communicated 350 therethrough out the second aperture 340 from the primary interior 160 to the external environment 60, this creates an absolute pressure within the primary interior 160 that is less than the absolute pressure in the external environment 60 causing the primary interior 160 to be compressed resulting in the apparatus 50 being in an evacuated state 360 being defined as when the particulate items 300 are substantially in compressive contact with one another and also substantially immovable relative to one another, see FIG. 7, this results in the surrounding sidewall 115 becoming rigidified to provide a rigid shell to protect the article 65 and also the inner surface of the sidewall 145 somewhat shrinking around the article 65 to help keep the article 65 from having undesirable relative movement within the secondary interior 170.

Note that in the evacuated state 360, shrinkage is a concern (from the un-evacuated state 380), especially as related to the secondary interior 170, this is especially acute in the injured/broken limb evacuation support arts, wherein any shrinkage is undesirable plus notable if the shrinkage is differentiated as between two perpendicular axes which could cause even further damage to the injured/broken limb. In the present invention, the lengthwise orientation of the channels 175 being parallel to the longitudinal axis 120 ensures that evacuation 360 shrinkage is the most predominate along the longitudinal axis 120 and that shrinkage is minimal perpendicular to the longitudinal axis 120 by design to most grip the article 65 in its longwise axis that is substantially parallel to the longitudinal axis 120, as the article 65 bring typically a firearm has more structural rigidity in its long axis versus its short axis, thus the major compression is in the article 65 long axis where there is the most strength in the article 65.

Further the particulate items 300 are relatively movable and loose relative to one another being defined as an un-evacuated state 380 when the primary interior 160 is equalized in absolute pressure with the external environment 60 when the channels 175 and the primary interior 160 are un-evacuated therethrough the second aperture 340 thereby placing the apparatus 50 into the un-evacuated state 380 allowing the sidewall 115 to be pliable, facilitating the article 65 to be taken from the pocket 165 therethrough the first aperture 330 or disposed within the pocket 165 therethrough the first aperture 330. Optionally, a valve 345 is in fluid communication 350 with the second aperture 340 to create a substantial seal with the valve 345 in a closed state as between the primary interior 160 and the external environment 60 to substantially hold the evacuated state 360 of the primary interior 160, further the valve 345 can be placed into an open state 355 allowing the un-evacuated state 380 to occur.

Optionally in looking at FIGS. 5 to 8, for the encasement protective apparatus 50 for the article 65, each channel interior 176 can further comprise a fluid permeable retention mat 400 that is positioned lengthwise being parallel to the longitudinal axis 120. Wherein the retention mat 400 axially divides each channel interior 176 into a filled interior 401 and an open interior 402. Wherein the compressible particulate items 300 are disposed within the filled interior 401 operationally to help keep the compressible particulate items 300 substantially evenly distributed forming the continuous strata 305 of the particulate items 300 within the primary interior 160 via being disposed evenly within the plurality of channel 175 interiors 176 as between the first 125 and second 130 end portions and as between the first 135 and second 140 margin portions, wherein operationally when in the evacuated state 360 a volume of each open interior 402 is substantially reduced, see FIG. 7.

Further, as an option for the encasement protective apparatus 50 for an article 65, each of the compressible particulate items 300 can have a non-symmetrical outer surface 310 that is operational to substantially cause each compressible particulate item 300 to frictionally interlock with an adjacent compressible particulate item 300 in the evacuated state 360 to further add to the rigidified shell, see FIG. 7 in particular.

Also, optionally, for the encasement protective apparatus 50 for the article 65, the second aperture 340 can further comprises a valve 345 disposed therein, wherein the valve 345 is selectively able to be placed in an open or a closed state, wherein the open state allows fluid flow 350 therethrough the second aperture 340 and the closed state substantially prevents fluid flow 350 therethrough the second aperture 340, see FIGS. 1, 4, 5, 9, 11, 12, and 14. A further option for the encasement protective apparatus 50 for an article 65, can further comprise a handle 410 that is partially affixed 411 to the flexible surrounding sidewall 115 outer surface portion 150, as best shown in FIGS. 10 to 14.

In addition, an option for the encasement protective apparatus 50 for the article 65, can further comprise an auxiliary pocket 420 that is partially affixed 421 to the flexible surrounding sidewall 115 outer surface portion 150, as best shown in FIGS. 10 to 14. Also, an option for the encasement protective apparatus 50 for the article 65, can further comprise can further comprise a pump 430 that is sized and configured to make a removably engagable substantially fluid tight interface with the valve 345, such that operationally pump 430 when activated results in the evacuated state 360 with the valve 345 is the open state 355, wherein the pump 430 is then de-activated and the valve 345 is placed in the closed state to substantially maintain the evacuated state 360, as best shown in FIG. 7, see also the pump 430 and valve 345 in FIGS. 1, 4, 5, 9, and 11 to 14. Note that the pump 430 can be part of a kit, along with the handles 410, and auxiliary pocket 420 for the encasement protective apparatus 50.

CONCLUSION

Accordingly, the present invention of an encasement protective apparatus 50 has been described with some degree of particularity directed to the embodiments of the present invention. It should be appreciated, though; that the present invention is defined by the following claims construed in light of the prior art so modifications of the changes may be made to the exemplary embodiments of the present invention without departing from the inventive concepts contained therein.

The invention claimed is:

1. An encasement protective apparatus for an article, said apparatus comprising:

(a) a flexible surrounding sidewall that is substantially fluid tight about a longitudinal axis, wherein said surrounding sidewall has a substantially fluid tight first end portion and an opposing substantially fluid tight second end portion wherein said longitudinal axis spanning therebetween, said surrounding sidewall also having a substantially fluid tight first margin portion and an opposing substantially fluid tight second margin portion, wherein said first and second margin portions are substantially parallel to said longitudinal axis, said surrounding sidewall also having an outer surface portion that is adjacent to an external environment and an inner surface portion that defines a primary interior formed by said sidewall, said first and second end portions, and said first and second margins, wherein said outer surface portion is attached at said first and second end portions forming a pocket that the article is disposed within, wherein said first and second margin portions at said outer surface are removably engagable to one another and define a first aperture opening, thereby said pocket defining a secondary interior, further a second aperture is disposed therethrough said sidewall allowing fluid communication from said primary interior into the external environment;

(b) a plurality of flexible longwise channels disposed within said primary interior, said longwise channels are parallel to said longitudinal axis, wherein said channels are affixed to one another in a juxtapose manner position, said plurality of channels extend continuously therethrough said primary interior from said first end portion to said second end portion, said channels each being positioned to one another to form a single flat one channel thick row of said plurality of channels as between said sidewall first and second margins for said single flat row and between said sidewall outer surface portions for said one channel thick row, said channels are fluid permeable within said primary interior, said channels each having a channel interior, said channels and said primary interior are all in fluid communication with one another and are also substantially sealed as against the external environment, such that said channels and said primary interior can have a portion of a fluid evacuated therethrough said second aperture into the external environment; and (c) a plurality of compressible particulate items loosely disposed within each of said channels being within said channel interior, each one of said channels are segmented such that said particulate items may not communicate as between each of said channels nor into said primary interior, said longwise channels form a continuous strata of said particulate items within said primary interior via being disposed within said plurality of channel interiors as between said first and second end portions and as between said first and second margin portions, wherein operationally when said channels and said primary interior have a portion of the fluid evacuated therethrough said second aperture, said apparatus is an evacuated state being defined as when said particulate items are substantially in contact with one another and also substantially immovable relative to one another, this results in said surrounding sidewall becoming rigidified to provide a rigid shell that partially encompasses the article to protect the article, further said particulate items are relatively movable and loose to one another being defined as an un-evacuated state when said channels and said primary interior are un-evacuated therethrough said second aperture thereby placing said apparatus into said un-evacuated state allowing the sidewall to be pliable, facilitating the article to be taken from the pocket or disposed within the pocket therethrough said first aperture.

2. An encasement protective apparatus for an article according to claim 1, wherein each said channel interior further comprises a fluid permeable retention mat that is positioned lengthwise being parallel to said longitudinal axis, wherein said retention mat axially divides each said channel interior into a filled interior and an open interior, wherein said compressible particulate items are disposed within said filled interior to operationally to help keep said compressible particulate items substantially evenly distributed forming said continuous strata of said particulate items within said primary interior via being disposed evenly within said plurality of channel interiors as between said first and second end portions and as between said first and second margin portions, wherein operationally when in said evacuated state a volume of each said open interior is substantially reduced.

3. An encasement protective apparatus for an article according to claim 1 wherein each of said compressible particulate items have a non-symmetrical outer surface that is operational to substantially cause each said compressible particulate item to frictionally interlock with an adjacent said compressible particulate item to further add to said rigidified shell.

4. An encasement protective apparatus for an article according to claim 1 wherein said second aperture further comprises a valve disposed therein, said valve is selectively able to be placed in an open or a closed state, wherein said open state allows fluid flow therethrough said second aperture and said closed state substantially prevents fluid flow therethrough said second aperture.

5. An encasement protective apparatus for an article according to claim 1 further comprising a handle that is partially affixed to said flexible surrounding sidewall outer surface portion.

6. An encasement protective apparatus for an article according to claim 1 further comprising an auxiliary pocket that is partially affixed to said flexible surrounding sidewall outer surface portion.

7. A kit for an encasement protective apparatus for an article, said kit comprising:

(a) a flexible surrounding sidewall that is substantially fluid tight about a longitudinal axis, wherein said surrounding sidewall has a substantially fluid tight first end portion and an opposing substantially fluid tight second end portion wherein said longitudinal axis spanning therebetween, said surrounding sidewall also having a substantially fluid tight first margin portion and an opposing substantially fluid tight second margin portion, wherein said first and second margin portions are substantially parallel to said longitudinal axis, said surrounding sidewall also having an outer surface portion that is adjacent to an external environment and an inner surface portion that defines a primary interior formed by said sidewall, said first and second end portions, and said first and second margins, wherein said outer surface portion is attached at said first and second end portions forming a pocket that the article is disposed within, wherein said first and second margin portions at said outer surface are removably engagable to one another and define a first aperture opening, thereby said pocket defining a secondary interior, further a second aperture is disposed therethrough said sidewall allowing fluid communication from said primary interior into the external environment;

(b) a plurality of flexible longwise channels disposed within said primary interior, said longwise channels are parallel to said longitudinal axis, wherein said channels are affixed to one another in a juxtapose manner position, said plurality of channels extend continuously therethrough said primary interior from said first end portion to said second end portion, said channels each being positioned to one another to form a single flat one channel thick row of said plurality of channels as between said sidewall first and second margins for said single flat row and between said sidewall outer surface portions for said one channel thick row, said channels are fluid permeable within said primary interior, said channels each having a channel interior, said channels and said primary interior are all in fluid communication with one another and are also substantially sealed as against the external environment, such that said channels and said primary interior can have a portion of a fluid evacuated therethrough said second aperture into the external environment;

(c) a plurality of compressible particulate items loosely disposed within each of said channels being within said channel interior, each one of said channels are segmented such that said particulate items may not communicate as between each of said channels nor into said primary interior, said longwise channels form a continuous strata of said particulate items within said primary interior via being disposed within said plurality of channel interiors as between said first and second end portions and as between said first and second margin portions, wherein operationally when said channels and said primary interior have a portion of the fluid evacuated therethrough said second aperture, said apparatus is an evacuated state being defined as when said particulate items are substantially in contact with one another and also substantially immovable relative to one another, this results in said surrounding sidewall becoming rigidified to provide a rigid shell that partially encompasses the article to protect the article, further said particulate items are relatively movable and loose to one another being defined as an un-evacuated state when said channels and said primary interior are un-evacuated therethrough said second aperture thereby placing said apparatus into said un-evacuated state allowing the sidewall to be pliable, facilitating the article to be taken from the pocket or disposed within the pocket therethrough said first aperture;

(d) a valve disposed within said second aperture, said valve is selectively able to be placed in an open or a closed state, wherein said open state allows fluid flow therethrough said second aperture and said closed state substantially prevents fluid flow therethrough said second aperture; and (e) a pump that is sized and configured to make a removably engagable substantially fluid tight interface with said valve, such that operationally said pump when activated results in said evacuated state with said valve is said open state, wherein said pump is then de-activated and said valve is placed in said closed state to substantially maintain said evacuated state.

8. A kit for an encasement protective apparatus for an article according to claim 7, further comprising an auxiliary pocket that is partially affixed to said flexible surrounding sidewall outer surface portion, wherein operationally said pump can be stowed within said auxiliary pocket.

9. A kit for an encasement protective apparatus for an article according to claim 7, further comprising a handle that is partially affixed to said flexible surrounding sidewall outer surface portion.

* * * * *